US007781663B2

(12) United States Patent
Totaka et al.

(10) Patent No.: US 7,781,663 B2
(45) Date of Patent: Aug. 24, 2010

(54) STORAGE MEDIUM STORING MUSICAL PIECE CORRECTION PROGRAM AND MUSICAL PIECE CORRECTION APPARATUS

(75) Inventors: Kazumi Totaka, Kyoto (JP); Yuichiro Okamura, Kyoto (JP)

(73) Assignee: Nintendo Co., Ltd., Kyoto-shi (JP)

( * ) Notice: Subject to any disclaimer, the term of this patent is extended or adjusted under 35 U.S.C. 154(b) by 170 days.

(21) Appl. No.: 12/076,806

(22) Filed: Mar. 24, 2008

(65) Prior Publication Data

US 2009/0199698 A1 Aug. 13, 2009

(30) Foreign Application Priority Data

Feb. 12, 2008 (JP) ..... 2008-030659

(51) Int. Cl.
*G10H 1/00* (2006.01)

(52) U.S. Cl. ..... 84/612; 84/636; 84/652

(58) Field of Classification Search ..... 84/609, 84/612, 636, 649, 652, 668
See application file for complete search history.

(56) References Cited

U.S. PATENT DOCUMENTS 4,993,306 A * 2/1991 Ueta et al. ..... 84/601
5,241,125 A * 8/1993 Miyamoto ..... 84/609
5,629,490 A * 5/1997 Inaba ..... 84/171
5,990,404 A * 11/1999 Miyano ..... 84/609
6,307,141 B1 * 10/2001 Laroche et al. ..... 84/636
6,945,784 B2 * 9/2005 Paquette et al. ..... 434/307 A
7,193,148 B2 * 3/2007 Cremer et al. ..... 84/635
7,273,978 B2 * 9/2007 Uhle ..... 84/609
2003/0023421 A1 * 1/2003 Finn et al. ..... 704/1
2007/0234882 A1 * 10/2007 Usa et al. ..... 84/612
2009/0199698 A1 * 8/2009 Totaka et al. ..... 84/611

FOREIGN PATENT DOCUMENTS

JP 6-250648 9/1994

* cited by examiner

*Primary Examiner*—David S. Warren
(74) *Attorney, Agent, or Firm*—Nixon & Vanderhye, P.C.

(57) ABSTRACT

A musical piece correction apparatus corrects a sounding timing (note-on timings) of a sound constituting apart of a musical piece. First, the musical piece correction apparatus reads, from storage means, music performance data indicating sounding timings in the musical piece. Next, the musical piece correction apparatus sets a plurality of reference timings (grids) in a performance period of the musical piece, and sets, for each reference timing, a reference period (area) including said each reference timing. At this point, from among sounding timings included in the reference period, a nearest sounding timing to said each reference timing is selected, and the selected sounding timing is corrected so as to coincide with said each reference timing.

20 Claims, 15 Drawing Sheets

STORAGE MEDIUM STORING MUSICAL PIECE CORRECTION PROGRAM AND MUSICAL PIECE CORRECTION APPARATUS

CROSS REFERENCE TO RELATED APPLICATION

The disclosure of Japanese Patent Application No. 2008-030659, filed Feb. 12, 2008, is incorporated herein by reference.

BACKGROUND OF THE INVENTION

1. Field of the Invention

The present invention relates to a musical piece correction program and a musical piece correction apparatus. The present invention particularly relates to a musical piece correction program and a musical piece correction apparatus for correcting sounding timings of sounds constituting a musical piece.

2. Description of the Background Art

Conventionally, in the technical field of information processing for music performance data of a musical piece, there is processing called quantization for automatically correcting a sounding timing indicated by the music performance data. The quantization processing is for automatically adjusting the sounding timing indicated by the music performance data such that the sounding timing coincides with an ideal timing (quantized timing, typically a timing of sounding a note).

The above quantization processing has a problem in that a plurality of sounds having different sounding timings in the music performance data are corrected by the quantization processing such that the plurality of sounds have a same sounding timing. In order to solve this problem, an automatic music performance data correction apparatus disclosed in Patent Document 1 (Japanese Lain-Open Patent Publication No. 6-250648) shifts a sounding timing or deletes a sound from among a plurality of sounds whose sounding timings have been corrected to be at a single timing. To be specific, after the quantization processing, the automatic music performance data correction apparatus detects whether there are a plurality of sounds whose sounding timings have been corrected to be at a single timing, and, if there are, deletes a sound whose gate time (length of the sound) is shorter, or shifts one of the sounds to an adjacent quantized timing.

However, there may be a case where a music performance indicated by the music performance data includes not only sounds which are intended to be produced at quantized timings but also sounds which are intended to be produced at different timings from quantized timings. For example, in the case where the music performance data is inputted by, e.g., a person, the person (i.e., a user) may input the music performance data such that sounds are produced at different timings from quantized timings (hereinafter, referred to as improvised inputting). However, the automatic music performance data correction apparatus disclosed in Patent Document 1 eventually shifts sounding timings of all the sounds to quantized timings. For this reason, there is a case where an intention of the user, which is originally contained in the music performance data, is lost due to the quantization processing. In other words, when a method for adjusting the sounding timings of all the sounds to quantized timings is used, the corrected music performance data does not reflect at all an intention of the user (to deliberately deviate sounding timings from quantized timings). Thus, in the conventional quantization processing, the processed music performance data is standardized, and the conventional quantization processing does not support the improvised inputting by the user.

SUMMARY OF THE INVENTION

Therefore, an object of the present invention is to provide a musical piece correction program and a musical piece correction apparatus which are capable of adjusting rhythms in the music performance data while leaving information, which indicates an intention of the user and which is originally contained in the music performance data, uncorrected.

The present invention has the following features to achieve the object mentioned above. Note that, reference numerals, supplementary descriptions and the like indicated between parentheses in this section are merely provided to facilitate the understanding of the present invention in relation to the later-described embodiment, rather than limiting the present invention in any way.

A first aspect of the present invention is a computer-readable storage medium (optical disc 4) for storing a musical piece correction program (game program 60) to be executed by a computer (CPU 10) of a musical piece correction apparatus (game apparatus 3) for correcting a sounding timing (note-on timing) of a sound which constitutes a part of a musical piece. The musical piece correction program causes the computer to perform a music performance data reading step (S10), a reference timing setting step (S12 to S14), a reference period setting step (S15), a selecting step (S17) and a correction step (S18). At the music performance data reading step, the computer reads, from storage means (flash memory 17) of the musical piece correction apparatus, music performance data (63) indicating sounding timings in the musical piece. At the reference timing setting step, the computer sets a plurality of reference timings (grids) in a performance period of the musical piece. At the reference period setting step, the computer sets, for each reference timing, a reference period (area) including said each reference timing. At the selecting step, the computer selects, from among sounding timings included in the reference period, a nearest sounding timing to said each reference timing. At the correction step, the computer corrects the sounding timing selected at the selecting step such that the sounding timing coincides with said each reference timing.

In a second aspect of the present invention, at the reference timing setting step, the computer may set the plurality of reference timings at even intervals such that the reference timings each coincide with a timing at which a predetermined type of note (quarter note, eighth note, sixteenth note or the like) is sounded (step S12, see FIG. 8). At this point in the reference period setting step, the computer sets the reference period so as to have a same length as an interval of the predetermined type of note corresponding to each of the reference timings.

In a third aspect of the present invention, at the reference period setting step, the computer may set the reference period such that each of the reference timings is positioned at a center of the reference period.

In a fourth aspect of the present invention, at the reference timing setting step, the computer may set the plurality of reference timings such that a first interval and a second interval having different lengths from each other alternately appear (step S13, see FIG. 14). At this point in the reference period setting step, the computer sets the reference period such that a middle point between a reference timing and a next reference timing is a border of two adjoining reference periods.

In a fifth aspect of the present invention, at the selecting step, the computer may select, from among the sounding timings included in the reference period, the nearest sounding timing to said each reference timing. At this point in the correction step, the computer corrects only the sounding timing selected at the selecting step.

In a sixth aspect of the present invention, the music performance data may further contain data (note-off data 65) indicating muting timings (note-off timings) of sounds constituting the musical piece. Here, the musical piece correction program further causes the computer to perform a first deleting step (S24). At the first deleting step, the computer deletes a muting timing which is present between the selected sounding timing before a correction at the correction step and the selected sounding timing after the correction at the correction step, which muting timing is a muting timing of a different sound from a sound of the selected sounding timing (see FIG. 17).

In a seventh aspect of the present invention, the music performance data may further contain data (note-off data 65) indicating muting timings (note-off timings) of sounds constituting the musical piece. Here, the musical piece correction program further causes the computer to perform a shifting step (S27) and a second deleting step (S29). At the shifting step, the computer shifts a muting timing, which corresponds to the selected sounding timing, in a same direction and by a same amount as those of the selected sounding timing. At the second deleting step, the computer deletes the muting timing in the case where at the shifting step, the muting timing is shifted beyond a sounding timing of a sound which is different from a sound of the muting timing (see FIG. 19).

In an eighth aspect, at the correction step, the computer may correct a sounding timing, which is one of the sounding timings included in the reference period and which has not been selected at the selecting step, such that a time interval between the sounding timing and the selected sounding timing is maintained (see FIG. 21).

In a ninth aspect, at the correction step, in the case where there are a plurality of sounding timings which are among the sounding timings included in the reference period and which have not been selected at the selecting step, the computer may correct at least one of the plurality of sounding timings which have not been selected, such that a time interval ratio of the sounding timings included in the reference period is maintained (see FIG. 22).

In a tenth aspect of the present invention, the musical piece correction program may further cause the computer to perform: a music performance data inputting step (S1), a corrected data storing step (S22, S25) and a replaying step (S3). At the music performance data inputting step, the computer inputs the music performance data and causes the storage means (flash memory 17) to store the music performance data. At the corrected data storing step, the computer causes storing means (main memory) of the musical piece correction apparatus to store the music performance data whose sounding timing has been corrected at the correction step. At the replaying step, the computer reads the music performance data which has been corrected, and replays the musical piece.

The present invention may be realized in the form of a musical piece correction apparatus which has the same functions as those of the musical piece correction apparatus which performs the steps in the above first to tenth aspects. Note that, in the musical piece correction apparatus, a CPU executing the musical piece correction program may perform processes in the above steps, or a dedicated circuit of the musical piece correction apparatus may perform a part of or the entire processes in the above steps.

According to the first aspect, in a reference period, only a nearest sounding timing to a reference timing is corrected to be positioned on the reference timing, and the other sounding timings are not corrected to be positioned on the reference timing. As a result, when corrected music performance data is reproduced, sounds are produced not only at the reference timing but also at different timings from the reference timing. Therefore, according to the first aspect, an intention to produce a sound at a different timing from the reference timing can be reflected in a result of the correction. Thus, information, which is originally contained in the music performance data and which indicates the intention (of, e.g., a user having inputted the music performance data), can be left uncorrected. Further, in the first aspect, since the nearest sounding timing to the reference timing is corrected, this reduces aberration in a result of a music performance. Thus, according to the first aspect, rhythms in the music performance data can be adjusted while leaving information, which indicates the user's intention and which is originally contained in the music performance data, uncorrected.

According to the second aspect, the sounding timing is corrected to be a timing of a predetermined type of note. This allows a replay of the corrected music performance data to be natural. Further, according to the third aspect, the reference period is set so as to coincide with an interval of the predetermined type of note. This allows the replay of the corrected music performance data to be more natural.

According to the fourth aspect, a plurality of reference timings are set such that the first interval and the second interval having different lengths from each other alternately appear. This makes it possible to replay, using corrected music performance data, a result of a music performance in accordance with a bouncing rhythm (triplet-based rhythm or sextuplet-based rhythm).

According to the fifth aspect, in the reference period, only the nearest sounding timing to the reference timing is corrected to be at a position of the reference timing, and the other sounding timings are not corrected. This allows, for the other sounding timings, intentions contained in original music performance data (before correction) to be left uncorrected.

According to the sixth aspect, when a sounding timing is corrected, the corrected sounding timing is prevented from being positioned to be earlier than a muting timing corresponding to a previous sounding timing. This prevents inappropriate music performance data, in which a sounding timing is positioned to be earlier than a muting timing corresponding to a previous sounding timing, from being generated.

According to the seventh aspect, by correcting a muting timing corresponding to a corrected sounding timing, a length of a sound of the sounding timing can be kept fixed before and after the correction. However, there is a possibility of a problem that by correcting the muting timing, the corrected muting timing is positioned to be later than a next sounding timing. According to the seventh aspect, this problem can be prevented from occurring.

Here, if an interval between a plurality of sounding timings indicated by music performance data before correction is different from the interval therebetween after the correction, a user may feel that the corrected music performance is strange. According to the eighth aspect, even if a sounding timing in the reference period is corrected, a time interval between sounding timings in the reference period is maintained. As a result, strangeness in the music performance represented by the corrected music performance data, which is caused by shifting only one sounding timing in the reference period, can be reduced.

According to the ninth aspect, even when a sounding timing in the reference period is corrected, a time interval ratio of sounding timings in the reference period is maintained. Therefore, similarly to the above eighth aspect, strangeness in the music performance represented by the corrected music performance data can be reduced.

According to the tenth aspect, inputted music performance data can be corrected, and then a result of a music performance, which has been corrected, can be replayed. This makes it possible to, e.g., correct a result of a music performance of a user, and allow the user to listen to the result of the music performance after the correction.

These and other objects, features, aspects and advantages of the present invention will become more apparent from the following detailed description of the present invention when taken in conjunction with the accompanying drawings.

DESCRIPTION OF THE PREFERRED EMBODIMENTS

Overall Game System Configuration

Figure 1:
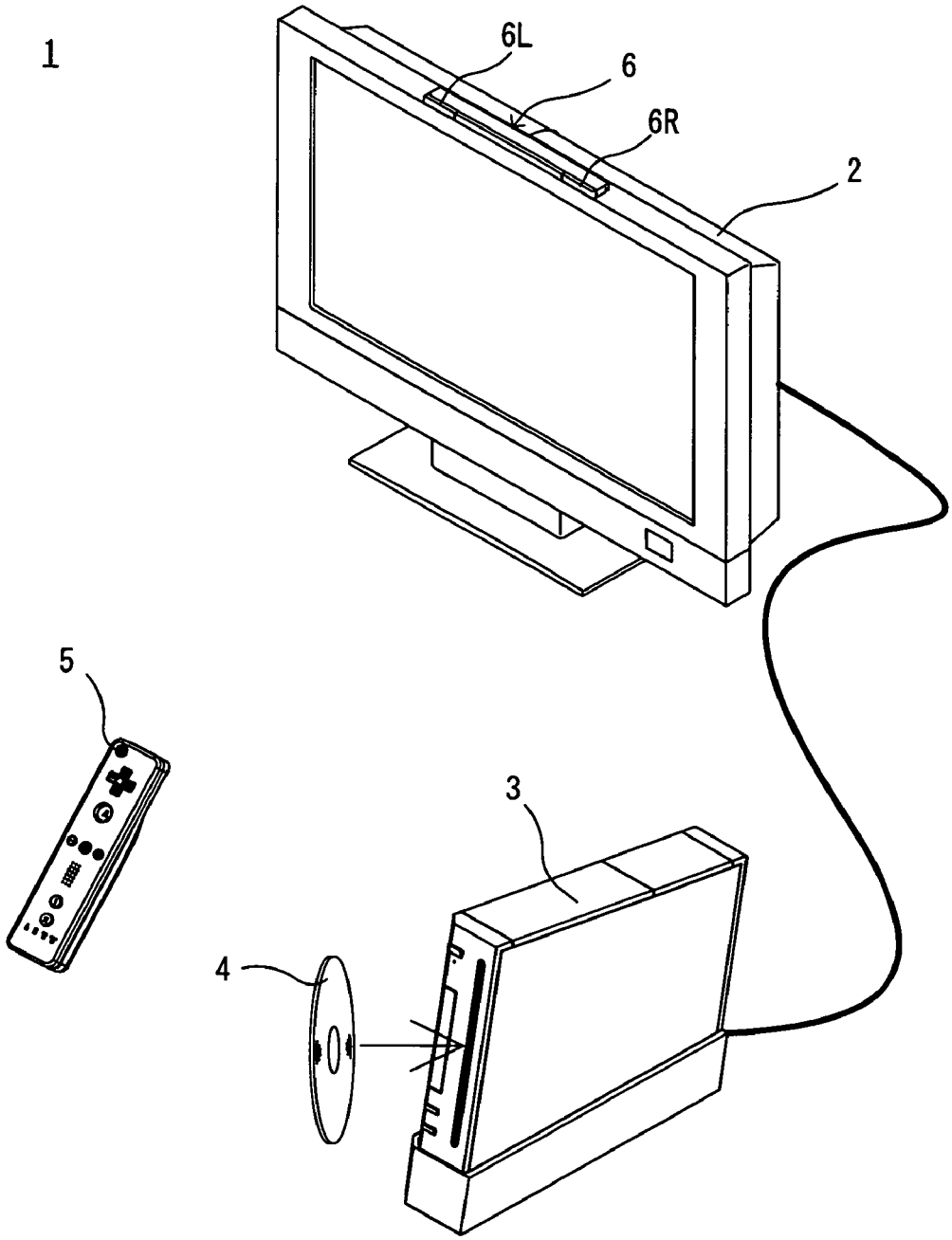
FIG. 1 is an external view of a game system 1.

Described below with reference to FIG. 1 is a game system including a game apparatus which is an example of a musical piece correction apparatus according to an embodiment of the present invention. FIG. 1 is an external view of the game system. Hereinafter, the musical piece correction apparatus and a musical piece correction program according to the present embodiment will be described using a stationary game apparatus and a game program as examples. As shown in FIG. 1, a game system 1 includes a home-use TV receiver (hereinafter, simply referred to as a "television") 2, a game apparatus 3, an optical disc 4, a controller 5 and a marker unit 6. This system is for performing, for a music game to input and replay a performance of a musical piece, a game process by the game apparatus 3 in accordance with a game operation performed using a controller 5.

The optical disc 4 as an example of an exchangeable information storage medium, from which data is readable, is detachably inserted to the game apparatus 3. The optical disc 4 stores a game program to be executed by the game apparatus 3. A front face of the game apparatus 3 is provided with an insertion slot for the optical disc 4. The game apparatus 3 reads and executes the game program stored in the optical disc 4 inserted to the insertion slot, thereby performing the game process. Note that, the game program may be prestored in an internal memory (the internal memory may be volatile although preferably nonvolatile) of the game apparatus 3. Alternatively, the game apparatus 3 may download the game program from a predetermined server (or from another game apparatus) which is connected to the game apparatus 3 via a network, and store the game program in the internal memory.

The game apparatus 3 is connected, by a connection cord, to the television 2 which is an example of a display device. The television 2 displays a game image which is obtained as a result of the game apparatus 3 having performed the game process. A marker unit 6 is set in the vicinity of a screen of the television 2 (above the screen in FIG. 1). The marker unit 6 has two markers 6R and 6L at both ends thereof. To be specific, the marker 6R (as well as the marker 6L) is one or more infrared LEDs for outputting an infrared light forward from the television 2. The marker unit 6 is connected to the game apparatus 3, and the game apparatus 3 is able to control lighting up of each infrared LED included in the marker unit 6.

The controller 5 is an input device which supplies operation data to the game apparatus 3, the operation data indicating an operation performed on the controller 5. The controller 5 and the game apparatus 3 are connected to each other via wireless communication. In the present embodiment, Bluetooth (registered trademark) technology is used for the wireless communication between the controller 5 and the game apparatus 3, for example. In other embodiments, the connection between the controller 5 and the game apparatus 3 may be wired as long as the controller 5 and the game apparatus 3 are communicably connected.

(Internal Configuration of the Game Apparatus 3)

Figure 2:
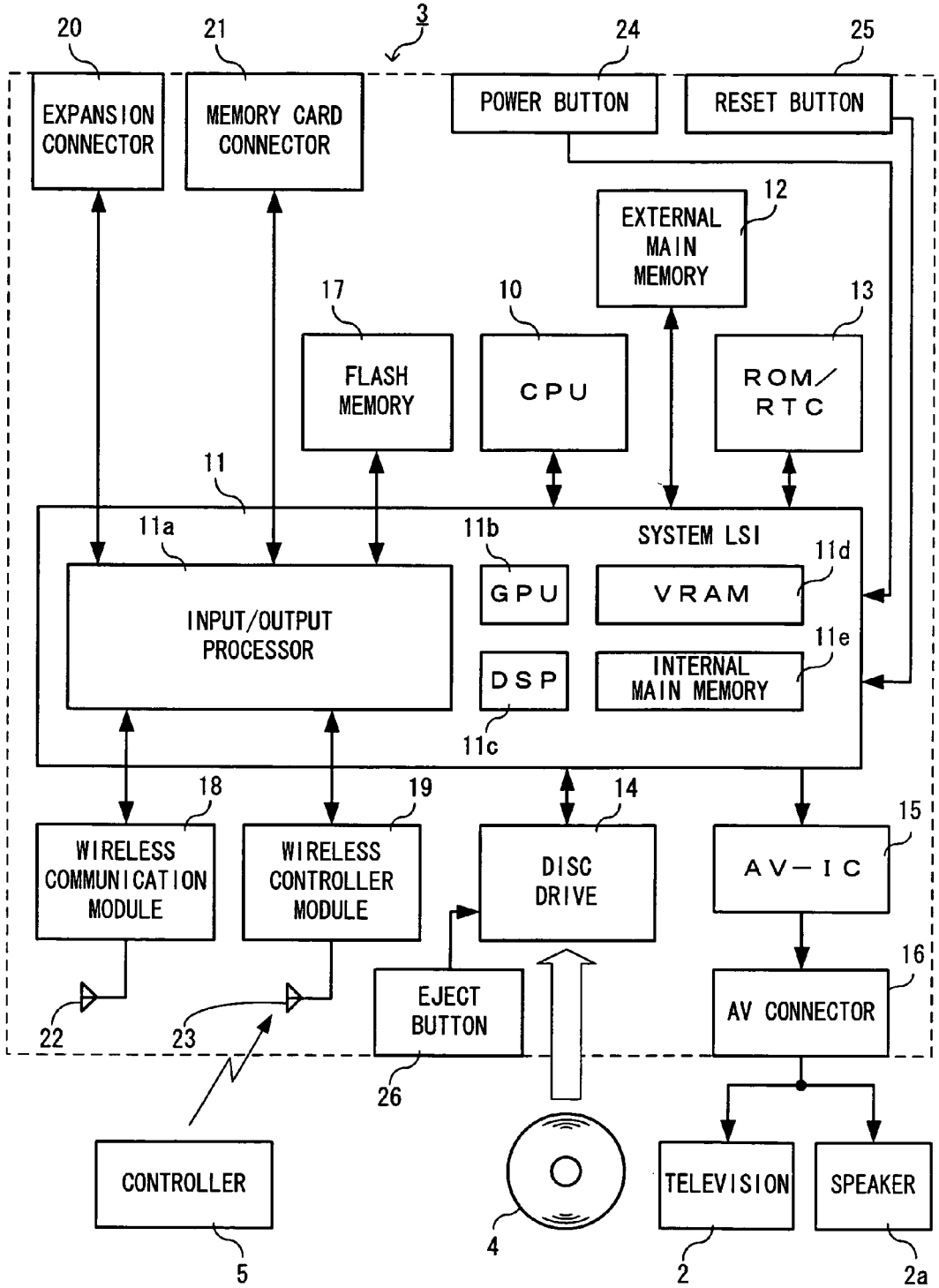
FIG. 2 is a functional block diagram of a game apparatus 3.

Next, an internal configuration of the game apparatus 3 will be described with reference to FIG. 2. FIG. 2 is a block diagram showing a configuration of the game apparatus 3. The game apparatus 3 has a CPU 10, a system LSI 11, an external main memory 12, a ROM/RTC 13, a disc drive 14, an AV-IC 15, and the like.

The CPU 10 performs the game process by executing the game program stored in the optical disc 4, and acts as a game processor. The CPU 10 is connected to the system LSI 11. In addition to the CPU 10, the external main memory 12, the ROM/RTC 13, the disc drive 14 and the AV-IC 15 are connected to the system LSI 11. The system LSI 11 performs processing such as: controlling data transfer among components connected to the system LSI 11; generating an image to be displayed; and obtaining data from external devices. An internal configuration of the system LSI 11 will be described later. The external main memory 12, which is a volatile memory, stores such a program as the game program loaded from the optical disc 4, or the game program loaded from the flash memory 17, and various data. The external main memory 12 is used as a work region or buffer region of the CPU 10. The ROM/RTC 13 has a ROM, in which a boot program for the game apparatus 3 is incorporated (so-called boot ROM), and a clock circuit (RTC: Real Time Clock) which counts the time. The disc drive 14 reads program data, texture data and the like from the optical disc 4, and writes the read data into a later-described internal main memory 11*e* or into the external main memory 12.

On the system LSI 11, an input/output processor (I/O processor) 11*a*, a GPU (Graphic Processor Unit) 11*b*, a DSP (Digital Signal Processor) 11*c*, a VRAM 11*d* and the internal main memory 11*e* are provided. Although not shown, these components 11*a* to 11*e* are connected to each other via an internal bus.

The GPU 11*b* partly forms rendering means, and generates an image in accordance with a graphics command from the CPU 10. The VRAM 11*d* stores necessary data for the GPU 11*b* to execute the graphics command (data such as polygon data and texture data). At the time of generating the image, the GPU 11*b* uses the data stored in the VRAM 11*d*, thereby generating image data.

The DSP 11*c* acts as an audio processor, and generates audio data by using sound data and sound waveform (tone) data stored in the internal main memory 11*e* and the external main memory 12.

The image data and the audio data generated in the above manner are read by the AV-IC 15. The AV-IC 15 outputs the read image data to the television 2 via the AV connector 16, and outputs the read audio data to a speaker 2*a* embedded in the television 2. As a result, the image is displayed on the television 2, and a sound is outputted from the speaker 2*a*.

The input/output processor 11*a* performs data transmission/reception with components connected thereto, and downloads data from external devices, for example. The input/output processor 11*a* is connected to the flash memory 17, a wireless communication module 18, a wireless controller module 19, an expansion connector 20 and a memory card connector 21. An antenna 22 is connected to the wireless communication module 18, and an antenna 23 is connected to the wireless controller module 19.

The input/output processor 11*a* is connected to a network via the wireless communication module 18 and the antenna 22, thereby communicating with other game apparatuses and various servers connected to the network. The input/output processor 11*a* regularly accesses the flash memory 17 to detect presence or absence of data which needs to be transmitted to the network. If such data is present, the data is transmitted to the network via the wireless communication module 18 and the antenna 22. Also, the input/output processor 11*a* receives, via the network, the antenna 22 and the wireless communication module 18, data transmitted from other game apparatuses or data downloaded from a download server, and stores the received data in the flash memory 17. By executing the game program, the CPU 10 reads the data stored in the flash memory 17 to use the data for execution of the game program. In addition to the data transmitted and received between the game apparatus 3 and other game apparatuses or various servers, the flash memory 17 may store saved data of the game which is played using the game apparatus 3 (such as result data or progress data of the game).

Further, the input/output processor 11*a* receives, via the antenna 23 and the wireless controller module 19, operation data transmitted from the controller 5, and stores (temporarily) the operation data in a buffer region of the internal main memory 11*e* or of the external main memory 12.

In addition, the expansion connector 20 and the memory card connector 21 are connected to the input/output processor 11*a*. The expansion connector 20 is a connector for such interface as USB or SCSI. The expansion connector 20, instead of the wireless communication module 18, is able to perform communications with a network by being connected to such a medium as an external storage medium, to a peripheral device, e.g., another controller, or a to connector for wired communication. The memory card connector 21 is a connector to be connected to an external storage medium such as a memory card. For example, the input/output processor 11*a* is able to access the external storage medium via the expansion connector 20 or via the memory card connector 21 to store or read data in and from the external storage medium.

On the game apparatus 3, a power button 24, a reset button 25 and an eject button 26 are provided. The power button 24 and the reset, button 25 are connected to the system LSI 11. When the power button 24 is turned on, each component of the game apparatus 3 is supplied with power via an AC adaptor which is not shown. When the reset button 25 is pressed, the system LSI 11 reexecutes the boot program of the game apparatus 3. The eject button 26 is connected to the disc drive 14. When the eject button 26 is pressed, the optical disc 4 is ejected from the disc drive 14.

(Configuration of the Controller 5)

Figure 3:
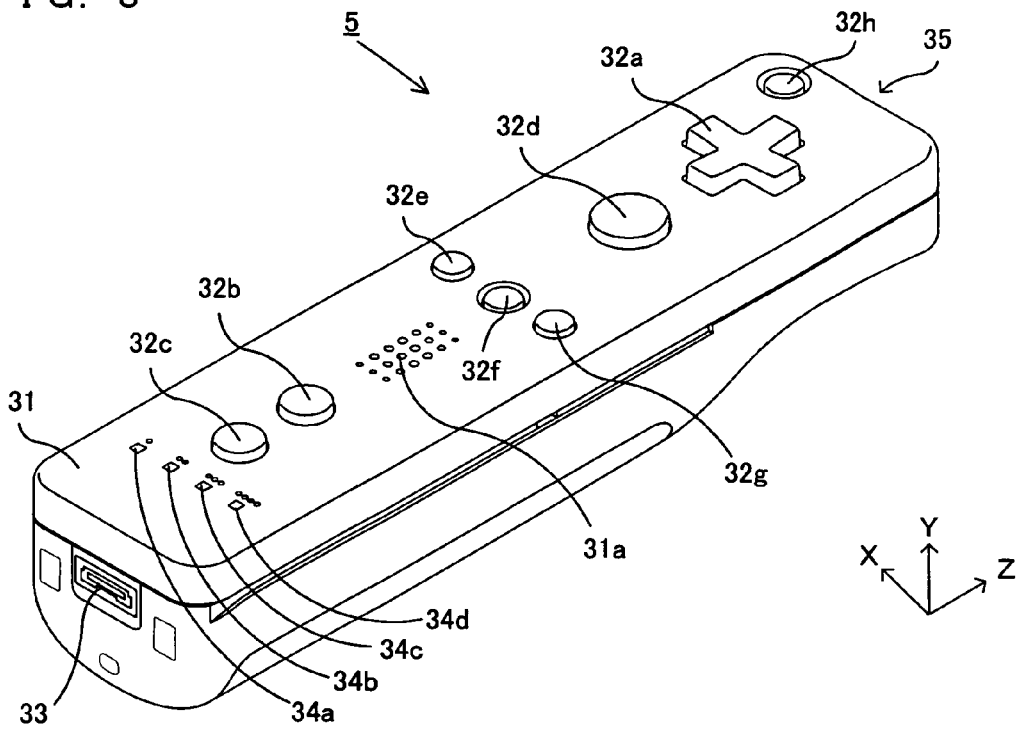
FIG. 3 is a perspective view showing an external structure of a controller 5.
Figure 4:
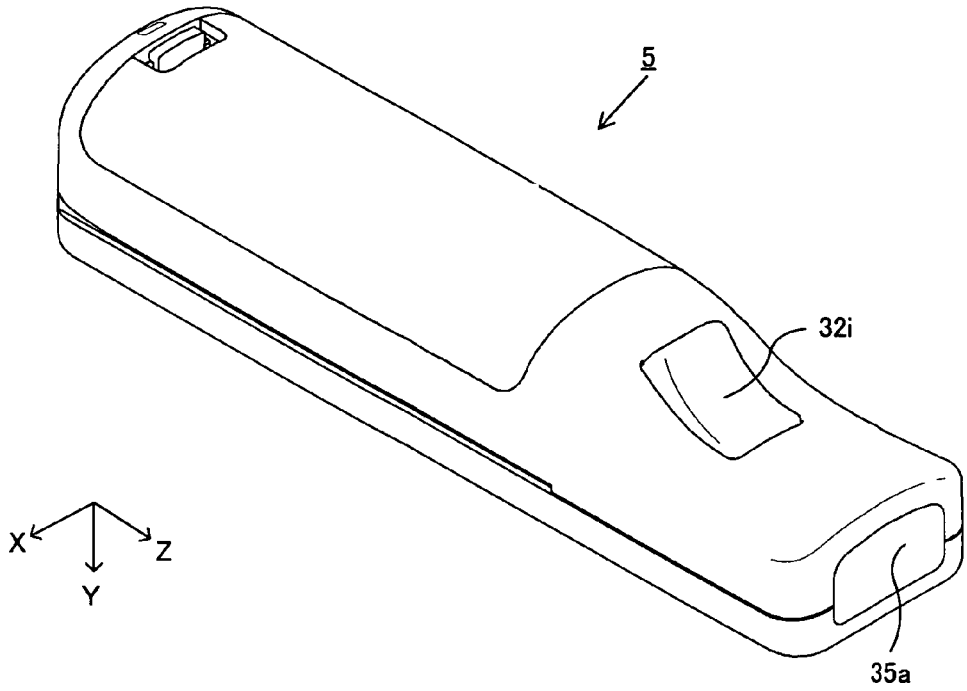
FIG. 4 is a perspective view showing an external structure of the controller 5.

Next, the controller 5 will be described with reference to FIGS. 3 to 7. FIGS. 3 and 4 are each a perspective view showing an external structure of the controller 5. FIG. 3 is a perspective view of the controller 5 seen from a top rear side thereof. FIG. 4 is a perspective view of the controller 5 seen from a bottom front side thereof.

As shown in FIGS. 3 and 4, the controller 5 includes a housing 31 formed by plastic molding or the like. The housing 31 has an approximately parallelepiped shape extending in a longitudinal direction from front to rear (i.e., extending in a Z-axis direction shown in FIG. 3). The overall size of the housing 31 is small enough to be held by one hand of an adult or even a child. A player can perform a game operation by pressing a button provided on the controller 5, or by moving the controller 5 to change a position or an orientation thereof.

The housing 31 is provided with a plurality of operation buttons. As shown in FIG. 3, a cross button 32*a*, a first button 32*b*, a second button 32*c*, an A button 32*d*, a minus button 32*e*, a home button 32*f*, a plus button 32*g*, and a power button 32*h* are provided on a top surface of the housing 31. As shown in FIG. 4, a bottom surface of the housing 31 has a recessed portion formed thereon, and a rear slope surface of the recessed portion is provided with a B button 32*i*. Appropriate functions are assigned to these operation buttons 32*a* to 32*i* in accordance with the game program executed by the game apparatus 3. The power button 32*h* is for turning on/off the game apparatus 3 from a remote position. The home button 32*f* and the power button 32*h* each have a top surface thereof buried in the top surface of the housing 31, so as not to be inadvertently pressed by the player.

A rear surface of the housing 31 is provided with a connector 33 which is used to connect the controller 5 to another device (e.g., another controller).

On a rear portion of the top surface of the housing 31, a plurality of LEDs (four LEDs in FIG. 3) 34*a* to 34*d* are provided. Here, a controller type (number) is assigned to the controller 5 such that the controller 5 is distinguishable from other controllers. The LEDs 34*a* to 34*d* are used for, e.g., informing the player of the controller type currently set for the controller 5, or informing the player of a remaining buttery level of the controller 5. Specifically, when a game operation is performed using the controller 5, one of the plurality of LEDs 34*a* to 34*d*, which corresponds to the controller type of the controller 5, is lit up.

Figure 6:
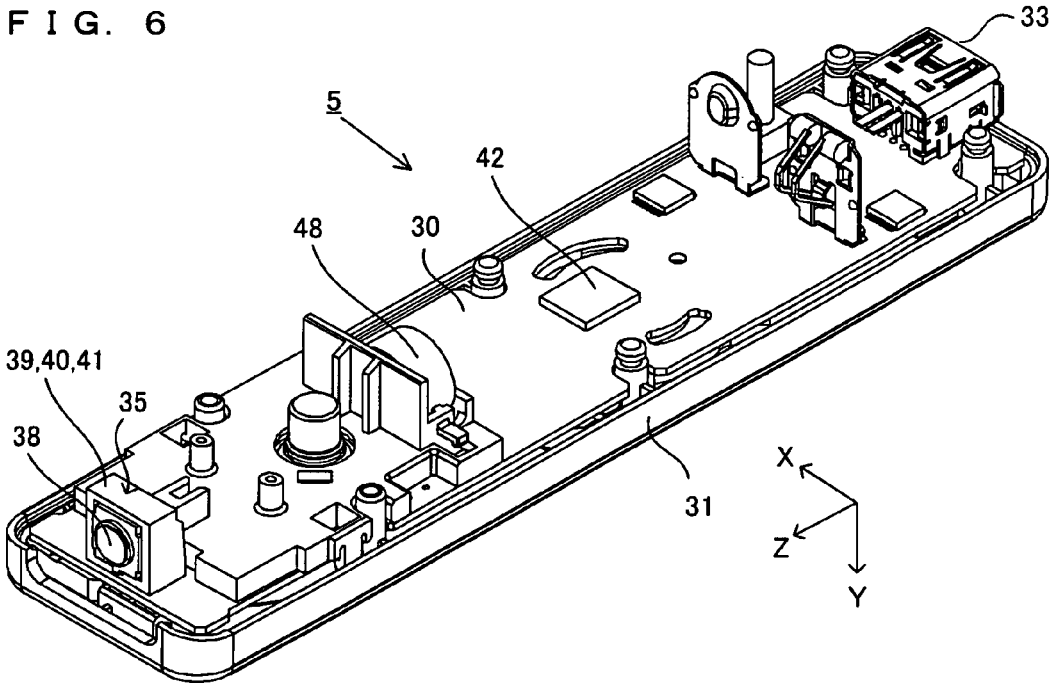
FIG. 6 shows an internal structure of the controller 5.

The controller 5 has an imaging information calculation section 35 (see FIG. 6). As shown in FIG. 4, a front surface of the housing 31 is provided with a light entrance surface 35*a* of the imaging information calculation section 35. The light entrance surface 35*a* is formed from a material which allows, at least, the infrared light from the markers 6R and 6L to pass therethrough.

Figure 5:
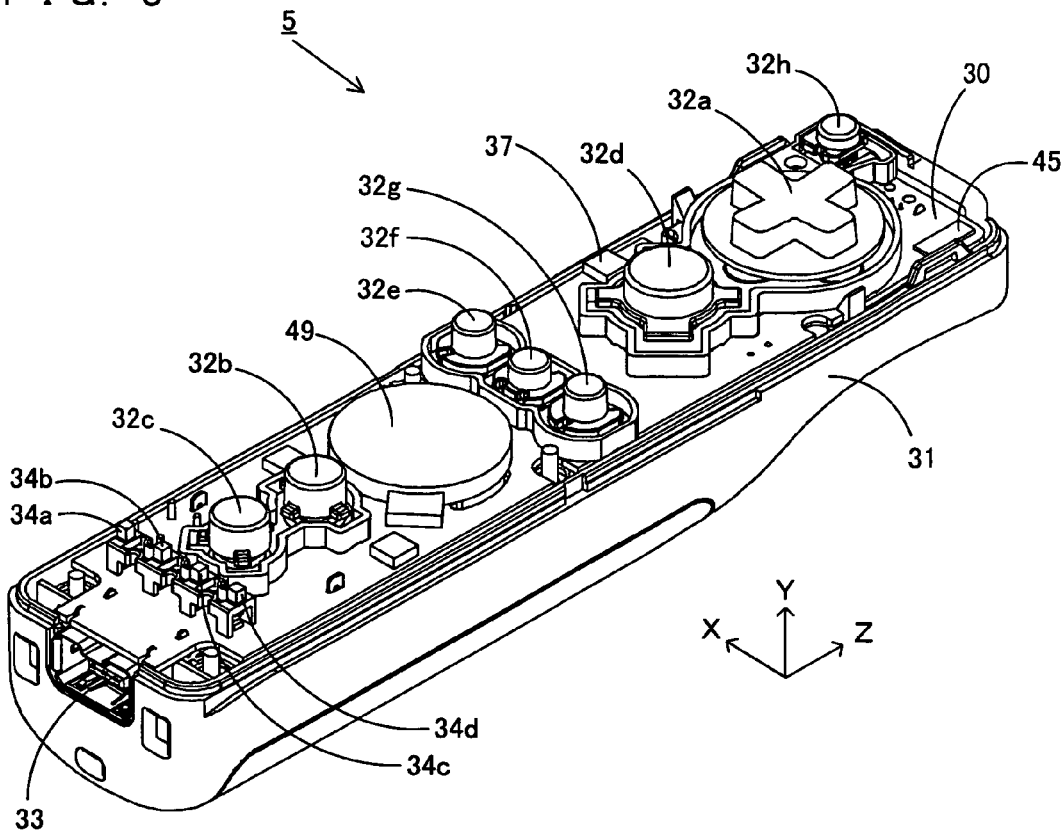
FIG. 5 shows an internal structure of the controller 5.

On the top surface of the housing 31, sound holes 31*a* are formed between the first button 32*b* and the home button 32*f*, for outputting, to the external space, sounds supplied from a speaker 49 embedded in the controller 5 (see FIG. 5).

Next, an internal structure of the controller 5 will be described with reference to FIGS. 5 and 6. FIGS. 5 and 6 show an internal configuration of the controller 5. FIG. 5 is a perspective view illustrating that an upper casing (a part of the housing 31) of the controller 5 is removed. FIG. 6 is a perspective view illustrating that a lower casing (a part of the housing 31) of the controller 5 is removed. Here, FIG. 6 is a perspective view showing a reverse side of a substrate 30 shown in FIG. 5.

As shown in FIG. 5, the substrate 30 is fixed inside the housing 31. On a top main surface of the substrate 30, the operation buttons 32*a* to 32*h*, the LEDs 34*a* to 34*d*, an acceleration sensor 37, an antenna 45, a speaker 49 and the like are provided. These elements are connected to a microcomputer 42 (see FIG. 6) by wirings (not shown) formed on the substrate 30 and the like. In the present embodiment, the acceleration sensor 37 is provided such that a position of the acceleration sensor 37 deviates, in an X-axis direction, from the center of the controller 5. As a result, when the controller 5 rotates with respect to the Z-axis, a motion of the controller 5 can be more easily calculated. Also, the acceleration sensor 37 is provided such that a position of the acceleration sensor 37 deviates, in a longitudinal direction (Z-axis direction), forward from the center of the controller 5. The controller 5 functions as a wireless controller by using a wireless module 44 (see FIG. 7) and the antenna 45.

As shown in FIG. 6, at a front edge of a bottom main surface of the substrate 30, the imaging information calculation section 35 is provided. The imaging information calculation section 35 comprises an infrared filter 38, a lens 39, an image pickup element 40 and an image processing circuit 41 which are located in said order from the front surface of the controller 5. These elements 38 to 41 are attached to the bottom main surface of the substrate 30.

On the bottom main surface of the substrate 30, the micro computer 42 and a vibrator 48 are provided. The vibrator 48 may be, for example, a vibration motor or a solenoid. The vibrator 48 is connected to the microcomputer 42 by wirings formed on the substrate 30 and the like. The controller 5 is vibrated when the vibrator 48 is actuated in accordance with an instruction from the microcomputer 42, and the vibration is conveyed to the player's hand holding the controller 5. Thus, a so-called vibration-feedback game is realized. In the present embodiment, the vibrator 48 is provided at a relatively forward position in the housing 31. By positioning the vibrator 48 so as to deviate from the center of the controller 5, the vibration of the vibrator 48 significantly vibrates the entire controller 5. The connector 33 is attached to a rear edge of the bottom main surface of the substrate 30. Other than the components shown in FIGS. 5 and 6, the controller 5 comprises a quartz oscillator for generating a reference clock of the microcomputer 42, an amplifier for outputting an audio signal to the speaker 49, and the like.

It is understood that the shape of the controller 5, the shapes of the operation buttons, the number and the setting position of acceleration sensors and vibrators, and the like shown in FIGS. 3 to 6 are merely examples. The present invention can be realized even if these shapes, numbers, setting positions and the like are different from the above description. Although an imaging direction of image pickup means is forward in the Z-axis direction in the present embodiment, the imaging direction may be in any direction. In other words, the position of the imaging information calculation section 35 (the light entrance surface 35*a* of the imaging information calculation section 35) of the controller 5 is not necessarily on the front surface of the housing 31. The imaging information calculation section 35 may be provided on any other surface of the housing 31 as long as the imaging information calculation section 35 is able to externally receive a light.

Figure 7:
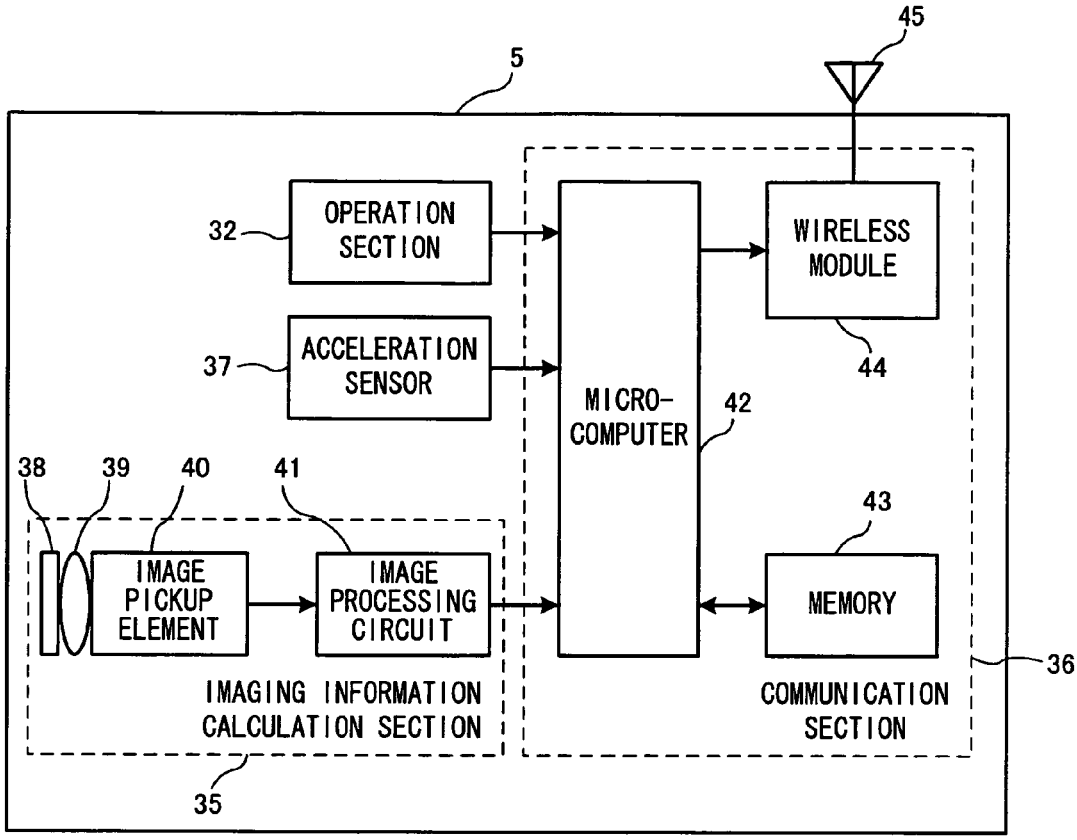
FIG. 7 is a block diagram showing a configuration of the controller 5.

FIG. 7 is a block diagram showing a configuration of the controller 5. The controller 5 includes an operation section 32 (operation buttons 32*a* to 32*i*), the connector 33, the imaging information calculation section 35, a communication section 36 and the acceleration sensor 37. The controller 5 transmits, as operation data to the game apparatus 3, data indicating operations performed on the controller 5.

The operation section 32 includes the above-described operation buttons 32*a* to 32*i*. The operation section 32 outputs, to the microcomputer 42 of the communication section 36, operation button data indicating an input status of each of the operation buttons 32*a* to 32*i* (i.e., operation button data indicating whether or not each of the operation buttons 32*a* to 32*i* is pressed).

The imaging information calculation section 35 is a system for: analyzing image data of an image taken by the image pickup means; identifying an area having a high brightness in the image; and calculating a position of a center of gravity, a size and the like of the area. The imaging information calculation section 35 has, for example, a maximum sampling period of approximately 200 frames/sec, and therefore can trace and analyze even a relatively fast motion of the controller 5.

The imaging information calculation section 35 includes the infrared filter 38, the lens 39, the image pickup element 40 and the image processing circuit 41. The infrared filter 38 allows, among lights incident thereon through the front surface of the controller 5, only an infrared light to pass therethrough. The lens 39 converges the infrared light having passed through the infrared filter 38, and allows the infrared light to be incident on the image pickup element 40. The image pickup element 40 is a solid-state image pickup element such as a CMOS sensor or a CCD sensor. The image pickup element 40 receives the infrared light collected by the lens 39, and outputs an image signal. Here, the markers 6R and 6L of the marker unit 6 provided in the vicinity of a display screen of the television 2 each comprise infrared LEDs for outputting an infrared light forward from the television 2. Accordingly, by providing the infrared filter 38, the image pickup element 40 generates image data by receiving only the infrared light having passed through the infrared filter 38. This allows images of the markers 6R and 6L to be more precisely taken. Hereinafter, an image taken by the image pickup element 40 is referred to as a taken image. The image data generated by the image pickup element 40 is processed by the image processing circuit 41. The image processing circuit 41 calculates positions of imaging subjects (markers 6R and 6L) in the taken image. Hereinafter, coordinates indicating the calculated positions of the markers are referred to as "marker coordinates". The image processing circuit 41 outputs data of the marker coordinates (marker coordinate data) to the microcomputer 42 of the communication section 36. The marker coordinate data is transmitted as operation data by the microcomputer 42 to the game apparatus 3. The marker coordinates vary in accordance with an orientation and a position of the controller 5. Accordingly, the game apparatus 3 can use the marker coordinates to calculate the orientation and a position of the controller 5.

The acceleration sensor 37 detects acceleration (including gravitational acceleration) of the controller 5. In other words, the acceleration sensor 37 detects a force (including the gravity) applied to the controller 5. The acceleration sensor 37 detects, among acceleration applied to a detection section of the acceleration sensor 37, a value of acceleration in a linear direction (linear acceleration) along a sensing axis direction. In the present embodiment, the acceleration sensor 37 detects the linear acceleration for three axial directions with respect to the controller 5, i.e., an up-down direction (Y-axis direction shown in FIG. 3), a left-right direction (X-axis direction shown in FIG. 3), and a front rear direction (Z-axis direction shown in FIG. 3). The detected acceleration is represented by a three-dimensional vector (AX, AY, AZ) in an XYZ coordinate system which is set with respect to the controller 5. Data indicating the acceleration detected by the acceleration sensor 37 (acceleration data) is outputted to the communication section 36. Note that, since the acceleration detected by the acceleration sensor 37 varies in accordance with the orientation and the motion of the controller 5, the game apparatus 3 can calculate the orientation and the motion of the controller 5 by using the acceleration data.

The communication section 36 includes the microcomputer 42, a memory 43, the wireless module 44 and the antenna 45. The microcomputer 42 controls the wireless module 44 for wirelessly transmitting, to the game apparatus 3, data obtained by the microcomputer 42, while using the memory 43 as a storage area when processing.

Each data outputted from the operation section 32, the imaging information calculation section 35 and the acceleration sensor 37 to the microcomputer 42 (each of the operation button data, marker coordinate data and acceleration data) is temporarily stored in the memory 43. Each data is transmitted to the game apparatus 3 as the aforementioned operation data. In other words, at a timing at which a transmission to the wireless control module 19 of the game apparatus 3 is to be performed, the microcomputer 42 outputs the operation data stored in the memory 43 to the wireless module 44. The wireless module 44 uses, for example, the Bluetooth (registered trademark) technology to modulate, using the operation data, a carrier wave of a predetermined frequency and to radiate a faint radio signal from the antenna 45. In other words, the operation data is converted by the wireless module 44 into the faint radio signal, and then transmitted from the controller 5. The faint radio signal is received by the wireless control module 19 of the game apparatus 3. By demodulating and decoding the received faint radio signal, the game apparatus 3 can obtain the operation data. Then, the CPU 10 of the game apparatus 3 performs the game process based on the obtained operation data and the game program. Note that, the wireless transmission from the communication section 36 to the wireless control module 19 is sequentially performed at a predetermined cycle. Since game processing is generally performed at a cycle of 1/60 sec (1 frame time), the wireless transmission is preferred to be performed at this cycle or at a cycle of a shorter time period. The communication section 36 of the controller 5 outputs each operation data to the wireless control module 19 of the game apparatus 3 at intervals of, e.g., 1/200 sec.

Use of the above controller 5 allows the player to, in addition to performing conventional general game operations by pressing the operation buttons, perform an operation to designate an arbitrary position on the screen by using the controller 5 and an operation to move the controller 5. For example, in a later-described music performing game, the player can perform, by performing an operation to move the controller 5 downward, an input (sound input) for causing the game apparatus 3 to output a sound.

(Brief Description of a Game Performed by the Game Apparatus)

Next, the game performed by the game apparatus 3 will be briefly described. This game allows the player to use the controller 5 to do a music performance (to input music performance data), and replays a result of the music performance (music performance data) after the music performance has ended. Also, when replaying the result of the music performance, the game apparatus 3 performs a process (quantization process) for correcting a sounding timing contained in the result of the music performance such that the sounding timing coincides with a reference timing.

The game apparatus 3 receives an input performed on the controller 5, during a period when the player is allowed to do a music performance. During this period, the player uses the controller 5 to input a timing at which a predetermined instrumental sound is produced (sounding timing). The game apparatus 3 sequentially stores inputted sounding timings, thereby storing music performance data representing the result of the music performance. The music performance data indicates one or more sounding timings at which one or more sounds in the music performance are produced. The music performance data may indicate, in addition to the sounding timing, some of a muting timing (or a length), pitch, magnitude, tone (i.e., type of a sound source) or the like of each sound. In the present embodiment, the music performance data contains, e.g., data indicating sounds produced by inputs performed in the player's music performance, data indicating sounding timings at which the sounds are produced, and data indicating types of keys by which the inputs have been performed. Then, when the music performance is replayed, the sounds, which are associated in advance with the types of keys, are produced at the sounding timings, whereby a musical piece which has been performed is replayed. As the music performance data, MIDI (Musical Instrument Digital Interface) data may be used. As described above, in the present embodiment, the music performance data inputted by the player is stored in storage means of the game apparatus 3 (e.g., flash memory 17).

In the present embodiment, the music performance data is inputted by a person. In other embodiments, however, the music performance data is not limited to data inputted by a person. The music performance data may be any type of data as long as the music performance data indicates a sounding timing.

When an instruction to perform a replay is provided after the music performance data is stored, the game apparatus 3 replays the result of the music performance by using the stored music performance data. Here, the game apparatus 3 performs a process for correcting sounding timings indicated by the music performance data, and then replays the music performance by using the music performance data in which the sounding timings have been corrected. As will hereinafter be described in detail, in the present embodiment, not all the sounding timings indicated by the music performance data are always corrected. Only sounding timings satisfying a later-described condition are corrected. Hereinafter, a music performance data correction process (a process for correcting sounding timings indicated by the music performance data) of the present invention will be briefly described with reference to FIGS. 8 and 9.

(Brief Description of the Music Performance Data Correction Process)

Figure 8:
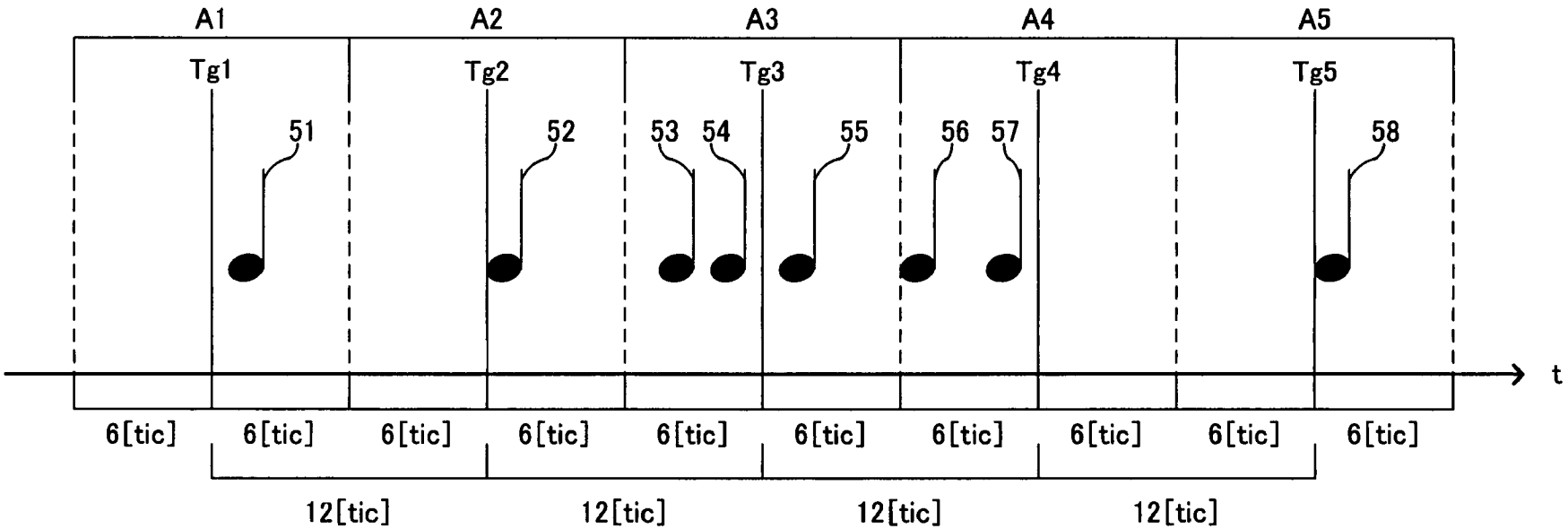
FIG. 8 shows an example of sounding timings in a music performance period.

FIG. 8 shows an example of sounding timings in a music performance period. FIG. 8 partly shows a period during which the entire musical piece is performed. In FIG. 8, the horizontal axis represents a time t. Also, notes 51 to 58 shown in FIG. 8 each represent a sounding timing along the temporal axis.

In the music performance data correction process, the game apparatus 3 first performs a music performance data reading step. In the music performance data reading step, the game apparatus 3 reads the music performance data from the storage means of the game apparatus 3. As described above, the music performance data in the present embodiment indicates sounding timings inputted by the player. The music performance data may be MIDI data. Note that, in the description below, the sounding timings are occasionally referred to as "note-on timings".

Next, the game apparatus 3 performs a reference timing setting step. At the reference timing setting step, the game apparatus 3 sets a plurality of reference timings within the period during which the musical piece is performed. Here, the reference timings (quantized timings) are each a timing which is used as a reference of a position (on the temporal axis) of a sounding timing after correction. In other words, a sounding timing to be corrected is corrected so as to coincide with one of the plurality of reference timings. In FIG. 8, timings Tg1, Tg2, Tg3, Tg4 and Tg5 are reference timings. The reference timings are set at even intervals such that each reference timing is, for example, a timing of a predetermined type of note (such as quarter note, eighth note and sixteenth note). Note that, the reference timings may not necessarily be set at even intervals (see FIG. 14) as long as the reference timings are set in accordance with a predetermined rule. FIG. 8 illustrates an example in which 48 tics represent 1 beat (having a length of a quarter note), and the reference timings are each set to be a timing of a sixteenth note. Here, in the present embodiment, time is represented in units of tics which are used for MIDI data, and time points in a period from the start to the end of a music performance are each represented by the number of tics. Note that, in the description below, the reference timings are occasionally referred to as "grids".

Then, the game apparatus 3 performs a reference period setting step. In the reference period setting step, the game apparatus 3 sets a reference period for each reference timing. One reference period is set for one reference timing so as to include said one reference timing. In FIG. 8, periods A1 to A5 are reference periods. In other words, the reference period A1 corresponds to the reference timing Tg1; The reference period A2 corresponds to the reference timing Tg2; the reference period A3 corresponds to the reference timing Tg3; the reference period A4 corresponds to the reference timing Tg4; and the reference period A5 corresponds to the reference timing Tg5. Note that, in FIG. 8, the reference periods are set such that each reference timing is positioned at the center of a corresponding reference period. To be specific, the reference periods are each set to have a 6-tic length both prior to and subsequent to a corresponding reference timing. However, the reference periods may each be set in any manner as long as a corresponding reference timing is included therein. Note that, in the description below, the reference periods are occasionally referred to as "areas".

Subsequently, the game apparatus 3 performs a selecting step. At the selecting step, the game apparatus 3 selects a nearest sounding timing to each reference timing from among sounding timings included in a corresponding reference period. The selecting step is for performing a process to select a sounding timing to be corrected. Specifically, in the example of FIG. 8, sounding timings indicated by notes 51, 52, 54, 57 and 58 are selected. In other words, since there is only one sounding timing in each of the reference periods A1, A2 and A5, the only one sounding timing in each period is selected (i.e., notes 51, 52 and 58 are selected). Further, selected from a plurality of sounding timings in each of the reference periods A3 and A4 is a nearest sounding timing to a corresponding reference timing (i.e., notes 54 and 57 are selected).

Figure 9:
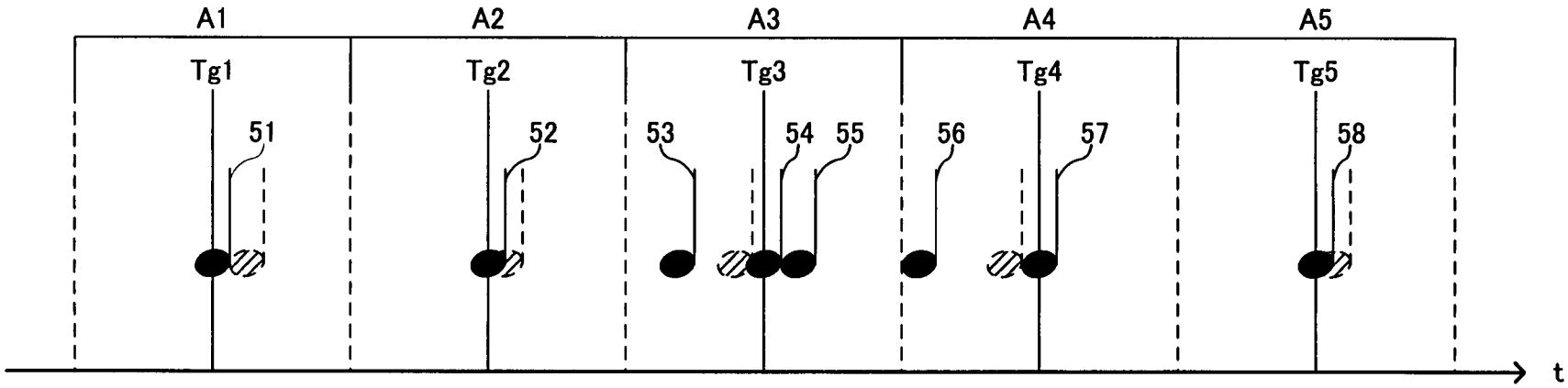
FIG. 9 shows that the sounding timings shown in FIG. 8 have been corrected.

Next, the game apparatus 3 performs a correction step. At the correction step, the game apparatus 3 corrects each sounding timing selected at the above selecting step such that said each sounding timing coincides with a corresponding reference timing. FIG. 9 shows that the sounding timings shown in FIG. 8 have been corrected. Note that, for the corrected sounding timings in FIG. 9, the sounding timings before the correction are represented by notes drawn by dotted lines and diagonal strokes. As shown in FIG. 9, the sounding timings selected at the correction step (sounding timings indicated by the notes 51, 52, 54, 57 and 58) are each corrected to be at a position of a nearest reference timing.

As described above, in the present embodiment, a timing correction process (quantization process) is performed for particular sounding timings from among the sounding timings indicated by the music performance data. The game apparatus 3 replays the result of the music performance by using the music performance data on which the correction process has been performed. As a result, even if inputted sounding timings in the music performance data slightly deviate from reference timings, sounds are produced at the reference timings when the result of the music performance is replayed. Thus, aberration in the result of the music performance is reduced. For example, when a beginner player who is not familiar with input operations performs a music performing operation, there may be a case where the player cannot input sounding timings well in accordance with reference timings. Even in this case, in the present embodiment, sounds are produced at the reference timings when the music performance is replayed. Therefore, aberration in the music performance is reduced when the music performance is replayed. This allows the beginner player to have an impression "My performance was not too bad".

Further, in the present embodiment, the timing correction is not performed for all the sounding timings. In the case where there are a plurality of sounding timings in a single reference period, the correction is not performed on different sounding timings from a nearest sounding timing to the reference timing. For this reason, even if the music performance is replayed using the corrected music performance data, there is a case where sounds are produced at different timings from reference timings. Thus, in the present embodiment, sounds can be produced not only at the reference timings but also at other timings. Accordingly, in the present embodiment, an intention to produce a sound at a different timing from a reference timing can be reflected in the replayed music performance, and information indicating the (player's) intention, which is originally contained in the music performance data, can be left uncorrected. For example, it is conceivable that a player familiar with the music performing operation not only produces sounds at predetermined timings (reference timings) but also improvises music performing operations by his/her own arrangements. The present embodiment allows the result of the music performance to be replayed in accordance with such improvised music performing operations. For example, consider a case where the player attempts to perform operations such that a plurality of sounds are produced at a particular reference timing. In this case, the music performance data which has not been corrected contains a plurality of sounding timings near the particular reference timing. When this music performance data is corrected in a conventional quantization process, the plurality of sounding timings are corrected such that only a single sound is produced at the reference timing. In the present embodiment, on the other hand, the plurality of sounding timings are left even after the music performance data has been corrected, and thus the corrected music performance data indicates a result of a music performance which reflects the player's intention.

(Details of the Game Process Performed by the Game Apparatus)

Figure 10:
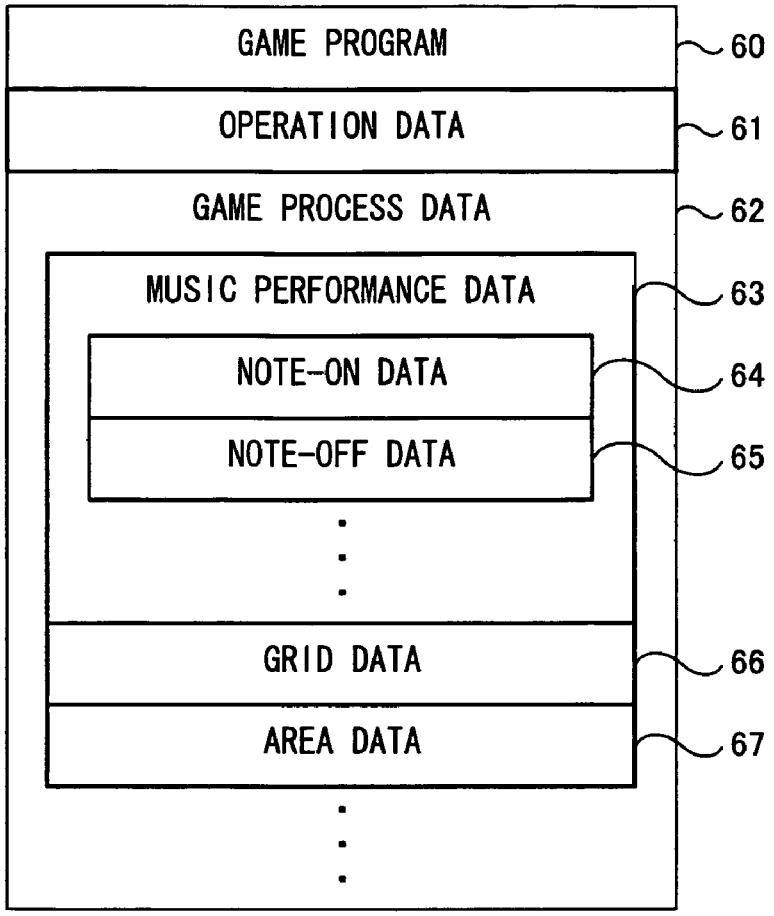
FIG. 10 shows main data stored in a main memory of the game apparatus 3.

Next, the game process performed by the game apparatus 3 will be described in detail with reference to a specific example of the game process using the above-described music performance data correction process. First, main data used for processing by the game apparatus 3 will be described with reference to FIG. 10. FIG. 10 shows the main data stored in a main memory of the game apparatus 3 (external main memory 12 or internal main memory 11*e*). As shown in FIG. 10, the main memory of the game apparatus 3 stores a game program 60, operation data 61 and game process data 62. Note that, the main memory stores, in addition to the data shown in FIG. 10, data of a sound source used for the game, image data of each object appearing in the game, data representing various parameters of objects, and the like which are necessary for the game process.

At an appropriate timing after the game apparatus 3 is turned on, a part of or the entire game program 60 is loaded from the optical disc 4 to be stored in the main memory. The game program 60 contains a program for performing the above-described music performance data correction process.

The operation data 61 is operation data transmitted from the controller 5 to the game apparatus 3. The operation data contains the operation button data indicating an input status of each of the operation buttons 32*a* to 32*i*, the marker coordinate data indicating the aforementioned marker coordinates, and the acceleration data indicating the acceleration (acceleration vector) detected by the acceleration sensor 37. As described above, the operation data is transmitted every 1/200 sec from the controller 5 to the game apparatus 3, and therefore the operation data stored in the main memory is updated at this rate. Note that, the main memory may store only latest (i.e., most recently obtained) operation data, or store the latest operation data together with previously obtained operation data. The game apparatus 3 determines, based on the operation data, a music performing operation performed by the player.

Figure 12:
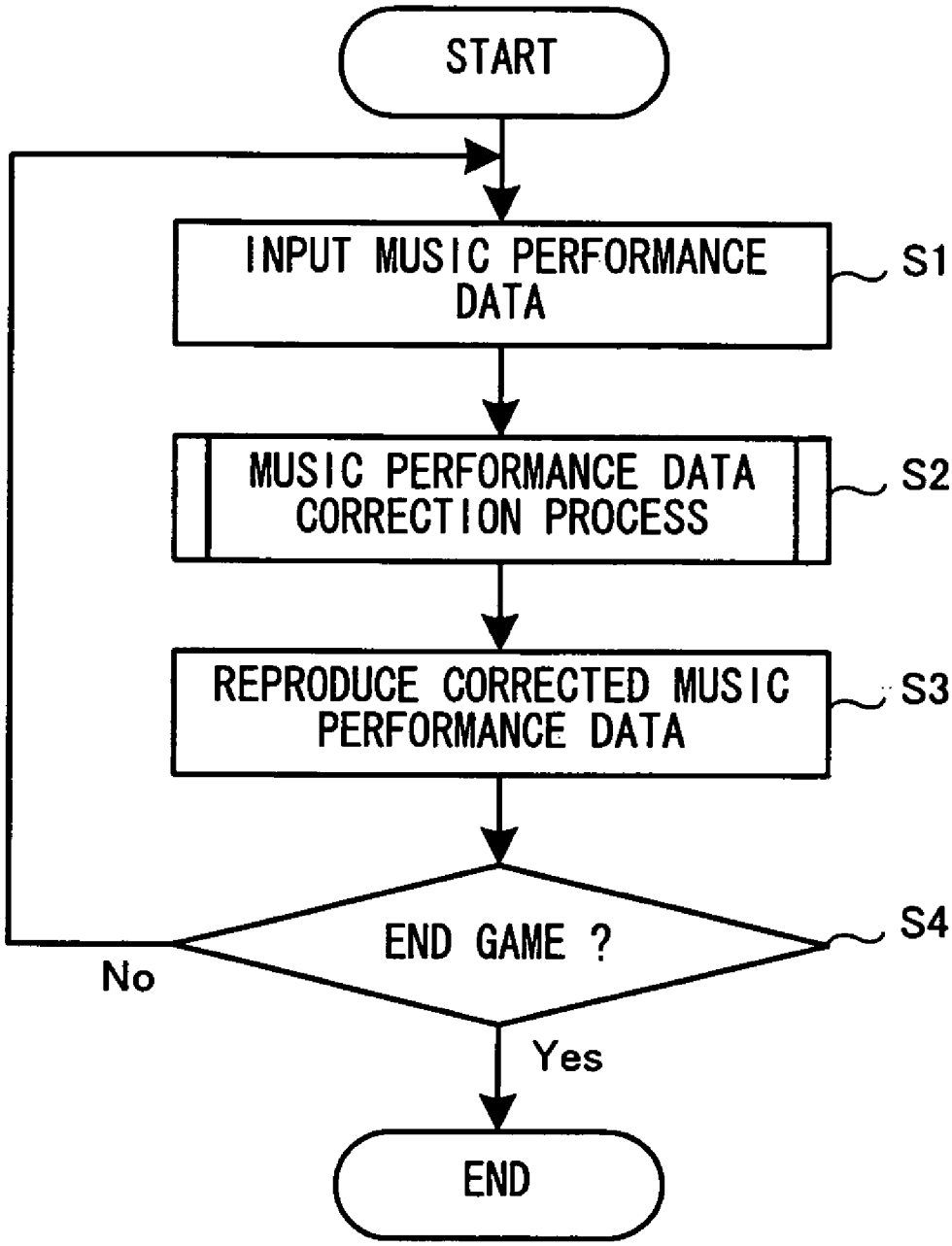
FIG. 12 is a main flowchart showing a flow of a game process performed by the game apparatus 3.

The game process data 62 is used in a later-described game process (FIG. 12). The game process data 62 contains music performance data 63, grid data 66 and area data 67. Note that, the game process data 62 contains, in addition to the data shown in FIG. 10, various data to be used in the game process.

The music performance data 63 indicates details of a musical piece performance. Specifically, the music performance data 63 indicates at least a sounding timing of each sound constituting the musical piece. As described above, in the present embodiment, the music performance data 63 contains note-on data 64 and note-off data 65. The note-on data 64 indicates note-on timings, that is, sounding timings of sounds constituting the musical piece. The note-off data 65 indicates note-off timings, that is, muting timings at which the sounds constituting the musical piece are muted (i.e., at which the sound production is ceased). Thus, in the present embodiment, the music performance data containing the muting timings in addition to the sounding timings is used, and the sounding timings and the muting timings are corrected in the music performance data correction process (at a later-described step S2). Hereinafter, the note-on timings and the note-off timings will be described with reference to FIG. 11.

Figure 11:
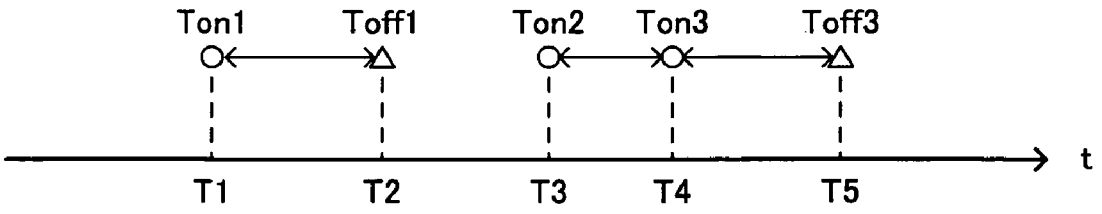
FIG. 11 shows note-on timings and note-off timings.

FIG. 11 shows note-on timings and note-off timings. In FIG. 11, the horizontal axis represents a time t; circles each represent a note-on timing; and triangles each represent a note-off timing. In FIG. 11, a note-on timing Ton1 (tic number=T1) and a corresponding note-off timing Toff1 (tic number=T2>T1); and a note-on timing Ton2 (tic number=T3>T2), a note-on timing Ton3 (tic number=T4>T3) and a note-off timing Toff3 (tic number=T5>T4) corresponding to the note-on timing Ton3, are set. In FIG. 11, sounds are produced in periods indicated by arrows. As shown in FIG. 11, the note-on timing is set for each sound constituting the musical piece. In other words, the music performance data 63 contains the same number of pieces of note-on data 64 as the number of sounds constituting the musical piece. On the other hand, as shown in FIG. 9, the note-off timing is not necessarily set for all the sounds. In the present embodiment, a sound, for which the note-off data 65 is not set, continues to be produced until a next sound is produced. For example, a sound produced at the note-on timing Ton2 (tic number=T3) shown in FIG. 11 continues to be produced until a next sounding timing, i.e., the note-on timing Ton3 (tic number=T4). Then, a sound is produced at the note-on timing Ton3 without having an interval.

In the present embodiment, similarly to MIDI data, the note-on data 64 and the note-off data 65 of the music performance data 63 each indicate timings by the number of tics counted from the start of the music performance (the number of tics is "0" at the start of the music performance). Note that, the note-off data 65 may indicate a length of each sound, i.e., a length (number of tics) from the note-on timing to the note-off timing, instead of indicating the number of tics indicating the note-off timing. Further, the music performance data 63 may contain, in addition to the note-on data 64 and the note-off data 65, data indicating a pitch, magnitude, tone and the like of each sound.

The music performance data 63 stored in the main memory is music performance data read from the flash memory 17 of the game apparatus 3, which music performance data 63 is previously stored in the flash memory 17 when a music performance data inputting process is performed (at a later-described step S1). Thereafter, contents of the music performance data 63 (note-on data 64 and note-off data 65) are corrected at the music performance data correction process, whereby the music performance data 63 is corrected. As a result, when the music performance data correction process is completed, the contents of the music performance data 63 are such that the note-on timings therein have been corrected.

The grid data 66 indicates one or more reference timings (grids) set on the temporal axis representing a period of the music performance. In the present embodiment, the grid data 66 is also, similarly to the note-on data 64 and the note-off data 65, represented by the number of tics counted from the start of the music performance. The grid data 66 is generated by the music performance data correction process, and then stored in the main memory. As will hereinafter be described in detail, in the present embodiment, there are two types of manners of setting the grids, and algorithms for the two types of setting manners are stored in the game program 60. In the music performance data correction process, the player selects one of the two types of grid setting manners.

The area data 67 indicates an area (reference period) set for each grid. To be specific, the area data 67 indicates a tic number at the start of the area and a tic number at the end of the area. The area data 67 is generated at the music performance data correction process, and then stored in the main memory. As will hereinafter be described in detail, in the present embodiment, there are two type of manners of setting the area, which respectively correspond to the above two types of grid setting manners. Algorithms for the two types of area setting manners are stored in the game program 60.

Next, the game process performed by the game apparatus 3 will be describe in detail with reference to FIGS. 12 to 19. FIG. 12 is a main flowchart showing a flow of the game process performed by the game apparatus 3. When the game apparatus 3 is turned on, and the optical disc 4 storing the game program is inserted into the game apparatus 3, the CPU 10 of the game apparatus 3 executes a boot program stored in a boot RAM (not shown), whereby each unit such as the main memory is initialized. Then, the game program stored in the optical disc 4 is loaded to the main memory, and the CPU 10 starts executing the game program. The flowchart shown in FIG. 12 shows a process which is performed after the above boot process is completed. Note that, although the description provided below describes that the CPU 10 performs the process shown in FIG. 12, the CPU 10 and the GPU 11*b* may cooperate with each other to perform together a part of the process (e.g., a process for generating and displaying a game image).

At step S1, the CPU 10 performs the music performance data inputting process. In the music performance data inputting process, the CPU 10 receives an input of a music performing operation performed by the player using the controller 5, thereby generating music performance data. The generated music performance data is stored in the flash memory 17. Hereinafter, an example of the music performance data inputting process will be described.

In the music performance data inputting process, when the performance of a musical piece starts, the CPU 10 starts receiving the music performing operation performed by the player. Here, the player may select a musical piece to perform from among musical pieces stored in the game program 60, or the game apparatus 3 may automatically determine the musical piece to perform. In order for the player to perform the music performing operation easily, when the performance of the musical piece starts, the CPU 10 starts playing accompaniment and displaying a game image indicating a performing timing. The accompaniment performs different parts from a part for an instrument used by the player. A score for the part to be performed by the player is displayed as the game image on the television 2, for example. Further, the CPU 10 may display an image (e.g., a mark) indicating a current position on the score such that the image is superimposed on the score. This allows the player to easily provide a note-on instruction for a grid at a precise timing. In other embodiments, the CPU 10 may not necessarily play the accompaniment or display the game image.

In the present embodiment, the music performing operation is for providing a note-on (sound production) instruction and a note-off (muting) instruction. In other words, the player uses the controller 5 to perform a note-on input and a note-off input. The note-on input and the note-off input may be performed in any manner. For example, the note-on input and the note-off input may be performed by an operation to move the controller 5 or by an operation to press a button of the controller 5. As a specific exemplary manner of performing these inputs, it is conceivable that an operation to move the controller 5 up and down (vertically) is set to be an operation to perform the note-on input, and an operation to press a predetermined button (e.g., B button 32*i*) is set to be an operation to perform the note-off input. Note that, a motion of the controller 5 can be calculated by using the acceleration data and/or the marker coordinate data contained in the operation data transmitted from the controller 5 to the game apparatus 3. Therefore, the CPU 10 can determine, based on the acceleration data and/or the marker coordinate data, whether or not an operation to move the controller 5 has been performed. As another specific exemplary manner of performing these inputs, it is conceivable that an operation to press a predetermined button is set to be an operation to perform the note-on input, and an operation to release the pressed predetermined button (i.e., to cancel the pressing of the button) is set to be an operation to perform the note-off input. Note that, in the present embodiment, the music performing operation for providing both the note-on and the note-off instructions can be inputted. In other embodiments, however, the music performing operation for providing only the note-on instruction can be inputted, and also, other information (a pitch, magnitude, tone or the like of a sound) can be inputted.

During the performance of the musical piece, the CPU 10 generates, in response to the note-on input operation having been received, note-on data indicating a tic number representing a point when the note-on input operation has been performed, and stores the note-on data as the music performance data in the main memory. Further, the CPU 10 generates, in response to the note-off input operation having been received, note-off data indicating a tic number representing a point when the note-off input operation has been performed, and stores the note-off data as the music performance data in the main memory. Note that, the CPU 10 may not only set the note-off timing in accordance with an input operation by the player, but also automatically set the note-off timing. To be specific, a point at which a predetermined time period has passed after the note-on timing may be set to be the note-off timing, and note-off data indicating this time period may be automatically generated and then stored in the main memory.

Thus, the note-on data and the note-off data are generated in the above manner during the music performance, whereby the music performance data is generated. Note that, in the present embodiment, only the note-on and note-off timings are determined in accordance with the music performing operation by the player, and the pitch, magnitude and tone of each sound is automatically determined by the CPU 10. As a result, the generated music performance data indicates information about each sound constituting the music performance, such as the note-on timing, note-off timing, pitch, magnitude, tone and the like. In the present embodiment, the generated music performance data (stored in the main memory) is transferred to the flash memory 17 and stored therein as saved data which indicates a result of the music performance. The flash memory 17 may store previously generated music performance data, thereby accumulating the result of the music performance until a current time point. Note that, in other embodiments, a memory to store the music performance data may be any memory. The music performance data may be stored in the main memory.

After the above-described step S1, a process at step S2 is performed. At step S2, the CPU 10 performs the music performance data correction process. The music performance data correction process is for correcting the note-on timing indicated by the music performance data. Hereinafter, the music performance data correction process will be described with reference to FIG. 13.

Figure 13:
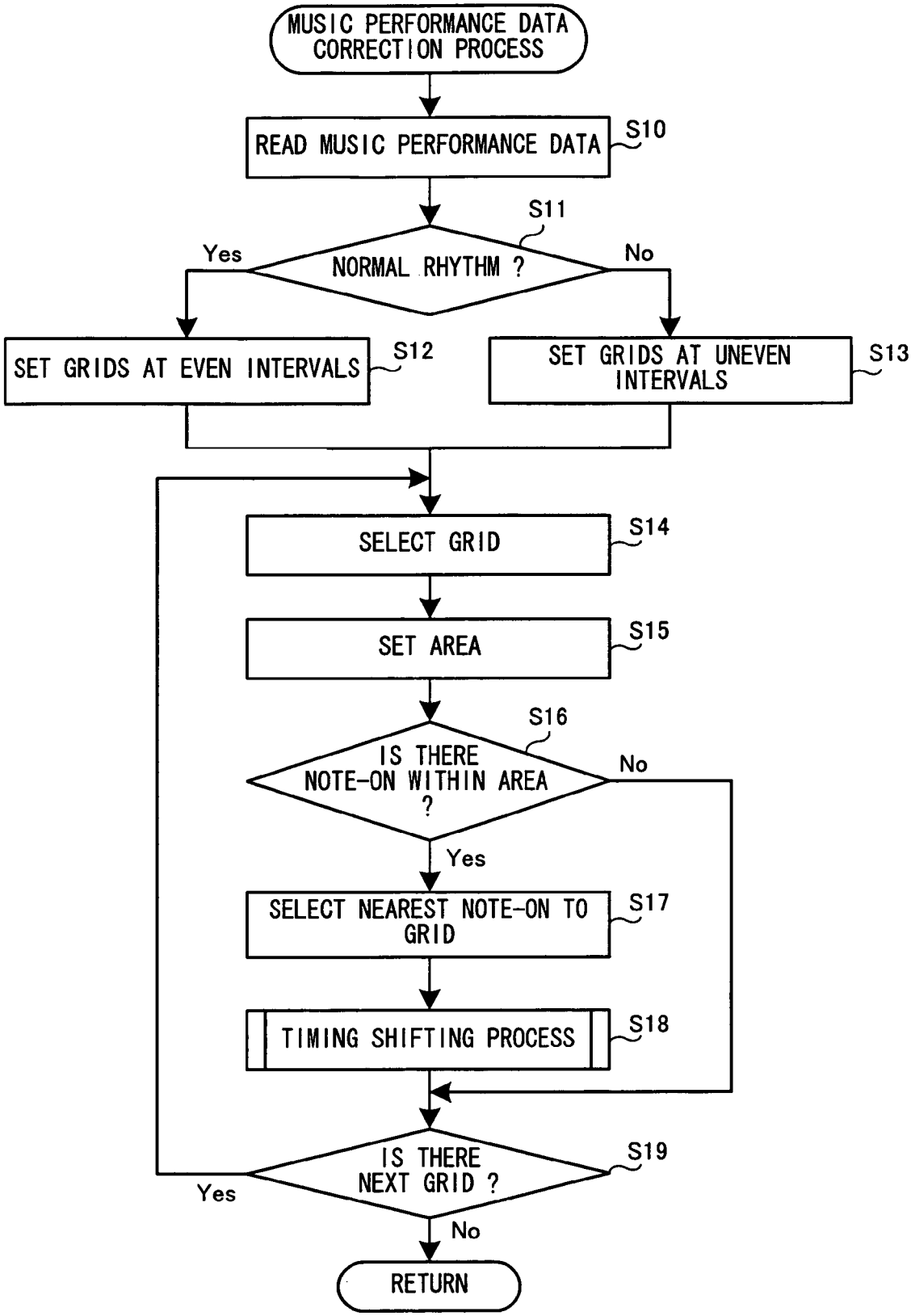
FIG. 13 is a flowchart showing a flow of a music performance data correction process (at step S2) shown in FIG. 12.

FIG. 13 is a flowchart showing a flow of the music performance data correction process (step S2) shown in FIG. 12. In the music performance data correction process, at step S10, the CPU 10 reads the music performance data stored in the flash memory 17, and then stores the music performance data in the main memory. The music performance data stored in the flash memory 17 is generated in the above-described music performance data inputting process (step S1). Note that, in the case where a plurality of types of music performance data, which have been previously generated, are stored in the flash memory 17, the CPU 10 may allow the player to select, from among the plurality of types of music performance data, music performance data to be reproduced. After step S10, a process at step S11 is performed.

At step S11, the CPU 10 determines whether or not to correct a sounding timing according to a normal rhythm. In the present embodiment, the game apparatus 3 is capable of correcting the sounding timing in either one of two types of correction methods, i.e., a correction according to a normal rhythm (first correction method) and a correction according to a bouncing rhythm (a triplet-based rhythm or a sextuplet-based rhythm) (second correction method). As will hereinafter be described in detail, a grid setting manner and an area setting manner of the first correction method are different from those the second correction method. In the present embodiment, the player selects the first or the second correction method. To be specific, on the television 2, the CPU 10 displays, for example, a game image which allows the player to select the first or the second correction method, and the CPU 10 receives an instruction input to select either one of the correction methods. The player performs an input to select either one of the first and the second correction methods by using the controller 5. The CPU 10 provides a determination at step S11 in accordance with the above input. To be specific, when the player selects the first correction method, a determination result at step S11 is positive, and when the player selects the second correction method, a determination result at step S11 is negative. When the determination result at step S11 is positive, a process at step S12 is performed. On the other hand, when the determination result at step S11 is negative, a process at step S13 is performed.

At step S12, the CPU 10 sets grids in the grid setting manner corresponding to the first correction method. Here, the grids are set at predetermined even intervals on the temporal axis representing the period of the music performance (see FIGS. 8 and 9). Typically, the grids are set at even intervals such that each grid coincides with a timing of a predetermined type of note (such as a quarter note, eighth note or sixteenth note). Accordingly, when the first correction method is selected, the correction of the note-on timing in the following processing is performed using the grids which are set at even intervals. Data indicating the grids (i.e., tic numbers respectively indicating positions of the grids) set at step S12 is stored in the main memory as the grid data 66.

Figure 14:
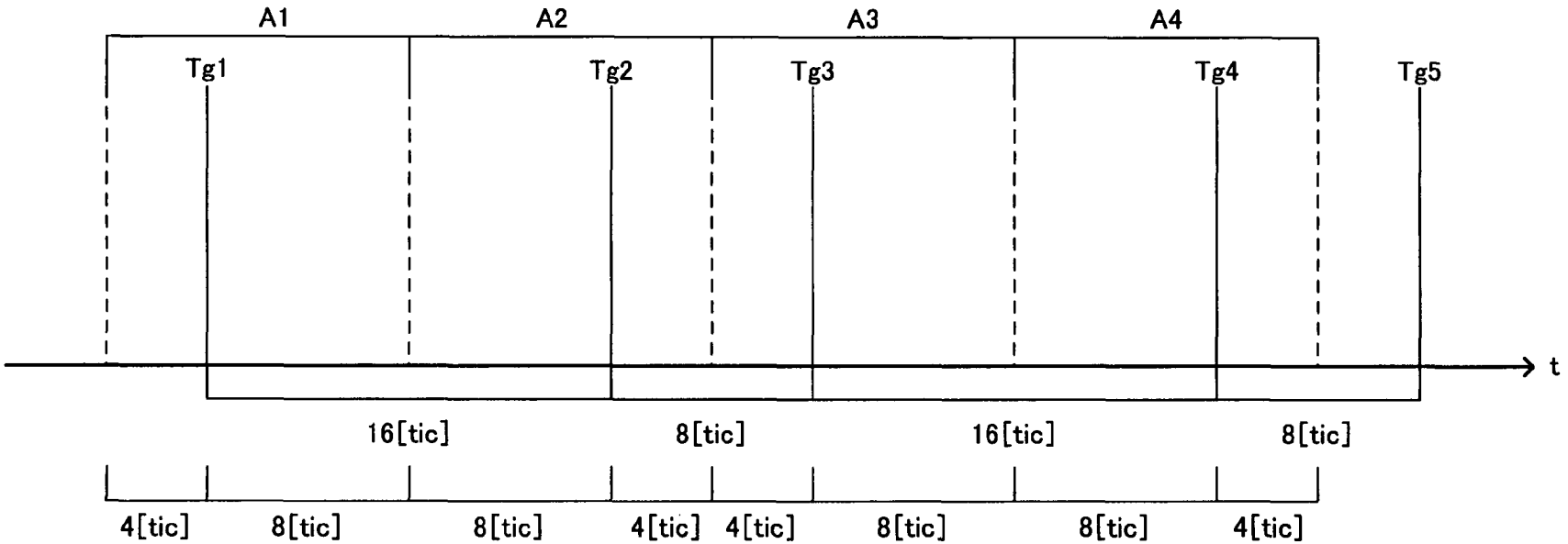
FIG. 14 shows an example of grids which are set when a second correction method is performed.

At step S13, on the other hand, the CPU 10 sets grids in the grid setting manner corresponding to the second correction method. Here, the grids are set at uneven intervals on the temporal axis representing the period of the music performance, such that two types of intervals having different lengths from each other alternately appear. FIG. 14 shows an example of grids which are set when the second correction method is performed. In FIG. 14, timings Tg1, Tg2, Tg3, Tg4 and Tg5 are grids, and periods A1, A2, A3, A4 and A5 are areas. Note that, in FIG. 14, one beat (having a length of a quarter note) is represented by 48 tics, and the grids, which are each set based on a sextuplet-based rhythm, are shown. In the second correction method, as shown in FIG. 14, the grids are set such that two types of intervals (16-tic interval and 8-tic interval shown in FIG. 14) alternately appear. Here, values respectively indicating these two types of intervals are predetermined. As described above, data indicating the grids set at step S13 is stored in the main memory as the grid data 66.

In the present embodiment, the grids are set using the above-described two types of setting manners. However, the grid setting manners may be any kind of manners. Also, in the present embodiment, the game apparatus 3 allows the player to select one of the plurality of types of grid selecting manners. However, in other embodiments, the CPU 10 may automatically perform the selection. For example, in the case where the game program 60 stores information about the musical piece (e.g., genre), one of the grid selecting manners may be selected based on the information.

Return to FIG. 13. After steps S12 or S13, a loop of processes at steps S14 to S19 is performed for a number of times, the number corresponding to the number of grids which have been set. In the loop of processes, a determination process (at a later-described step S16) is performed, for each grid, as to whether or not there is a note-on timing to be corrected to be positioned on said each grid. When there is a note-on timing to be corrected, the note-on timing is corrected (at a later-described step S18). In the loop of processes, the above determination process is sequentially performed for each grid, whereby the correction is eventually performed on the entire music performance data. Hereinafter, the loop of processes at steps S14 to S19 will be described in detail.

At step S14, the CPU 10 selects one of the grids which are set on the temporal axis representing the period of the music performance. The grid selection is sequentially performed, for one or more grids indicated by the grid data 66 stored in the main memory, in the order from the earliest grid on the temporal axis representing the period of the music performance. Hereinafter, a grid selected at step S14 is referred to as a "selected grid". Note that, data indicating the selected grid (e.g., data indicating a tic number of the selected grid) is stored in the main memory, separately from the grid data 66. After step S14, a process at step S15 is performed.

At step S15, the CPU 10 sets an area corresponding to the selected grid. Here, the area to be set is different between a case where the first correction method is performed and a case where the second correction method is performed. Hereinafter, a specific example of an area setting manner will be described separately for the case where the first correction method is performed and for the case where the second correction method is performed.

In the case where the first correction method is performed, the area is set such that the selected grid is positioned at the center of the area (see FIGS. 8 and 9). To be specific, the CPU 10 calculates, as a tic number at the start of the area, a tic number resulting from subtracting a predetermined value from a tic number of the selected grid, and also calculates, as a tic number at the end of the area, a tic number resulting from adding the predetermined value to the tic number of the selected grid. Note that, in the case where grids are set in the first correction method such that each grid coincides with a timing of a predetermined type of note, each area is typically set to have a same length as an interval of the predetermined type of note. More preferably, each grid is positioned at the center of a corresponding area.

On the other hand, when the second correction method is performed, each area is set as shown in FIG. 14 such that a middle position between a grid and a next grid is a border of two adjoining areas. In the example of FIG. 14, the areas A1, A2, A3 and A4 are set such that, in each area, one of prior and subsequent sides to a corresponding grid has a 8-tic width, and the other side has a 4-tic width. To be specific, the CPU 10 calculates, as a tic number at the start of an area, a tic number resulting from subtracting, from the tic number of the selected grid, a tic number which is ½ of an interval between the selected grid and a previous grid. The CPU 10 also calculates, as a tic number at the end of the area, a tic number resulting from adding, to the tic number of the selected grid, a tic number which is ½ of an interval between the selected grid and a next grid.

Data indicating the tic numbers at the start and the end of the area, which are calculated at step S15, is stored in the main memory as the area data 67. After step S15, a process at step S16 is performed.

At step S16, the CPU 10 determines whether or not there is a sounding timing in the area set at step S15. The determination at step S16 can be performed by referring to the music performance data 63 and the area data 67 stored in the main memory. In other words, a determination result at step S16 is positive when there is, among pieces of note-on data 64 contained in the music performance data 63, a piece of note-on data 64 which indicates a tic number within the area indicated by the area data 67. On the other hand, the determination result at step S16 is negative when there is not, among the pieces of note-on data 64 contained in the music performance data 63, a piece of note-on data 64 which indicates a tic number within the area indicated by the area data 67. When the determination result at step S16 is positive, a process at step S17 is performed. On the other hand, when the determination result at step S16 is negative, processes at steps S17 and S18 are skipped, and a process at a later-described step S19 is performed.

At step S17, the CPU 10 selects a note-on timing which is the nearest to the selected grid from among grids existing within the area set at step S15. That is, the CPU 10 selects a piece of note-on data 64 from among pieces of note-on data 64 contained in the music performance data 63, such that an absolute value of a difference between a tic number indicated by the piece of note-on data 64 and the tic number of the selected grid, is the smallest. Data indicating the note-on data 64 selected at step S17 is stored in the main memory as selected note-on data, separately from the note-on data 64. In the description below, the note-on-timing selected at step S17 is referred to as a "selected note-on timing". After step S17, a process at step S18 is performed.

If, at step S17, there are two note-on timings which are both nearest to the selected grid (i.e., the two note-on timings are respectively present at positions, one of which precedes the selected grid by a particular number of tics and the other of which follows the selected grid by the particular number of tics), the CPU 10 selects only one of them. Note that, in this case, which one of the note-on timing preceding the selected grid and the note-on timing following the selected grid is selected may be either predetermined or randomly determined.

At step S18, the CPU 10 performs a timing shifting process. In the timing shifting process, the selected note-on timing is shifted (corrected) to be positioned on the selected grid. Hereinafter, the timing shifting process will be described with reference to FIG. 15.

Figure 15:
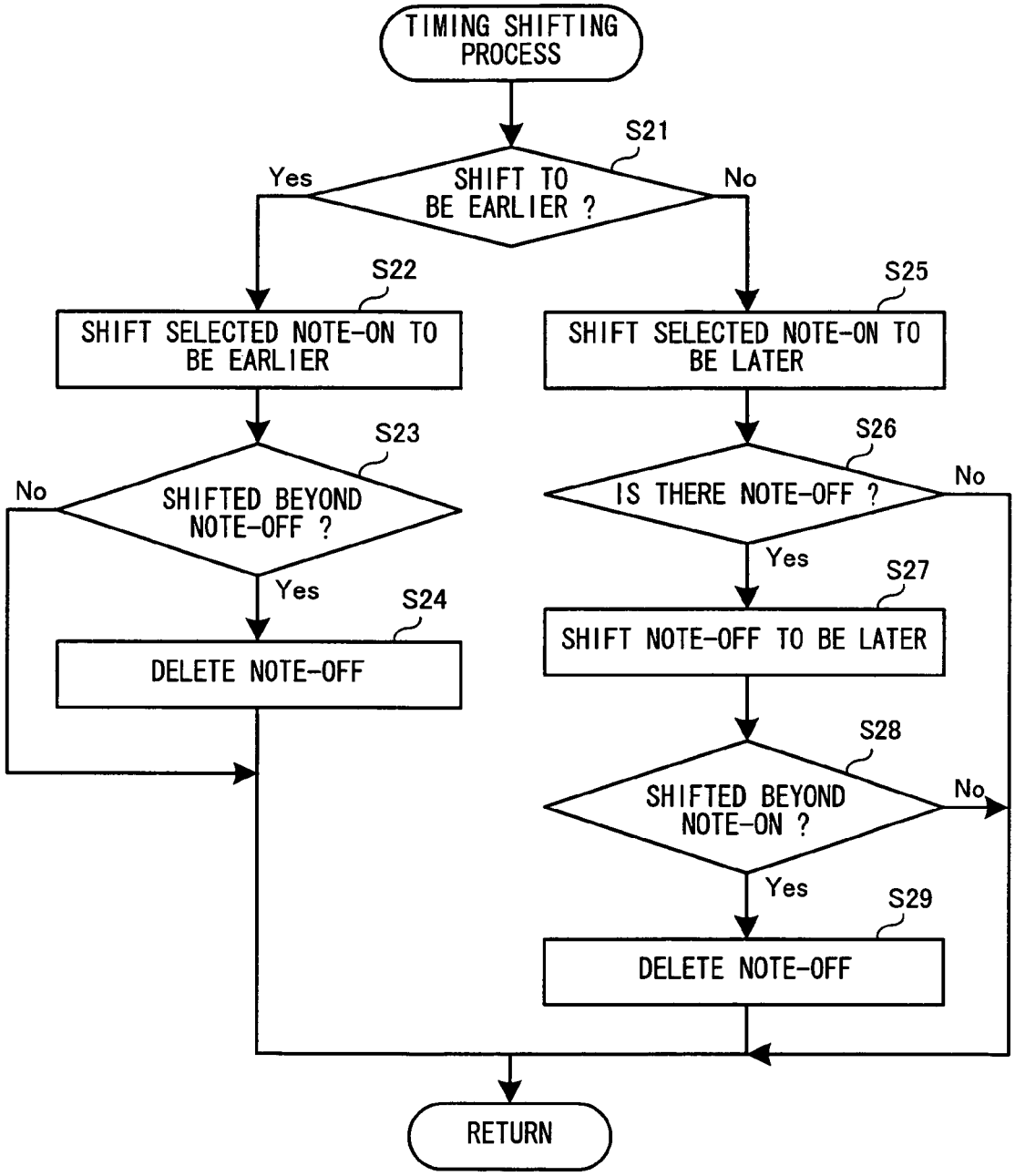
FIG. 15 is a flowchart showing a flow of a timing shifting process (at step S18) shown in FIG. 13.

FIG. 15 is a flowchart showing a flow of the timing shifting process (at step S18) shown in FIG. 13. In the timing shifting process, at step S21, the CPU 10 determines whether or not to shift the selected note-on timing to be earlier. The determination at step S21 can be performed using a magnitude relation between the tic number of the selected note-on timing and the tic number of the selected grid. To be specific, when the tic number of the selected note-on timing is greater than the tic number of the selected grid, this means that the selected note-on timing follows the selected grid. Accordingly, it is determined that the selected note-on timing needs to be shifted to be earlier. On the other hand, when the tic number of the selected note-on timing is smaller than the tic number of the selected grid, this means that the selected note-on timing precedes the selected grid. Accordingly, it is determined that the selected note-on timing needs to be shifted to be later. Note that, the tic number of the selected note-on timing can be obtained from the selected note-on data stored in the main memory, and the tic number of the selected grid can be obtained from the data indicating the selected grid, which data is stored in the main memory at step S14. When a determination result at step S21 is positive, a process at step S22 is performed. On the other hand, when the determination result at step S21 is negative, a process at a later-described step S25 is performed.

When, at step S21, the tic number of the selected note-on timing is the same as the tic number of the selected grid, the determination result at step S21 may be either positive or negative, because whether the determination result is positive or negative, the selected note-on timing is not shifted, and thus the outcome is the same. In the case where the tic number of the selected note-on timing is the same as the tic number of the selected grid, the CPU 10 may end the timing shifting process for the purpose of eliminating unnecessary processing.

At step S22, the CPU 10 shifts the selected note-on timing to be earlier. To be specific, the CPU 10 corrects a content of the note-on data 64, which content is indicated by the selected note-on data, such that the content indicates the tic number of the selected grid. In this manner, the selected note-on timing is shifted (corrected) to be positioned on the selected grid. After step S22, a process at step S23 is performed.

Figure 16:
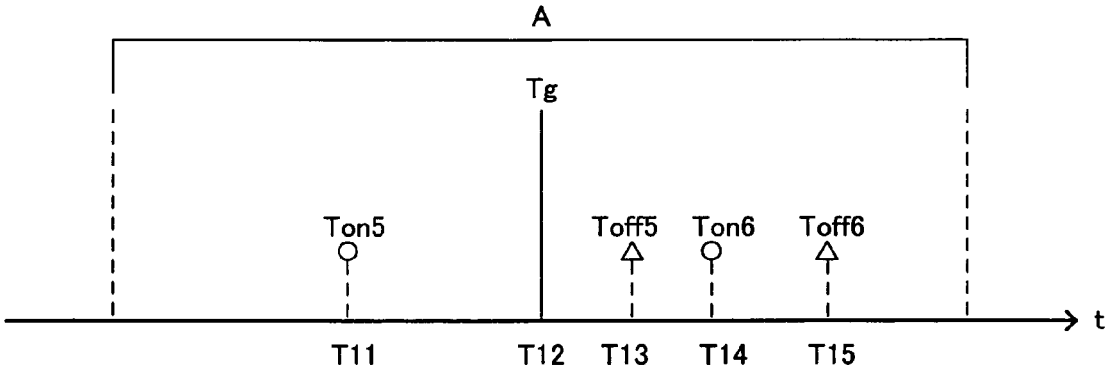
FIG. 16 shows that a selected note-on timing is shifted to be earlier.
Figure 17:
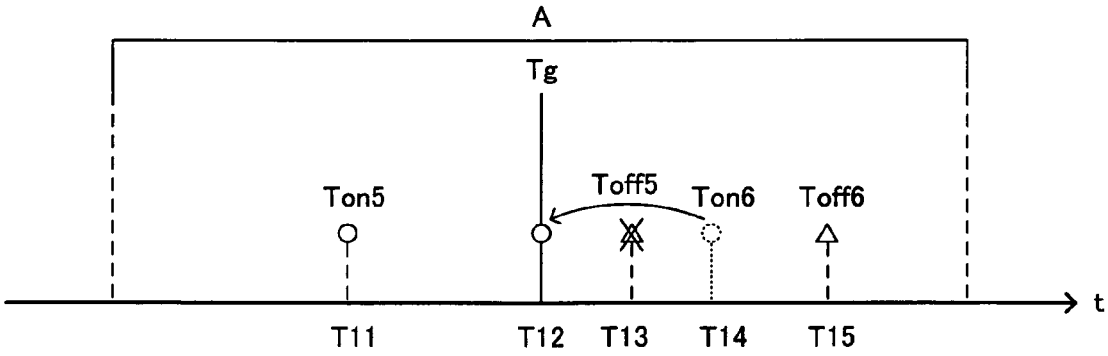
FIG. 17 shows that the selected note-on timing is shifted to be earlier.

Here, when the note-on timing is shifted to be earlier, there is a case where the note-on timing is shifted beyond a note-off timing corresponding to another note-on timing. FIGS. 16 and 17 show that the selected note-on timing is shifted to be earlier. In FIG. 16, a note-on timing Ton5 (tic number=T11) and a corresponding note-off timing Toff5 (tic number=T13>T11), and a note-on timing Ton6 (tic number=T14) and a corresponding note-off timing Tff6 (tic number=T15>T14) are set in an area A. Here, the note-on timing Ton6 is a selected note-on timing which is the nearest to a selected grid Tg (tic number=T12(T11<T12<T13)). In FIG. 16, when the selected note-on timing Ton6 is shifted to be positioned on the selected grid Tg, the selected note-on timing Ton6 is shifted beyond the note-off timing Toff5 as shown in FIG. 17. As a result, the selected note-on timing is positioned to be earlier than the note-off timing which is originally earlier than the selected note-on timing. This results in a failure to present note-on and note-off timings properly.

Therefore, in the present embodiment, in the case where the selected note-on timing shifts beyond a note-off timing, the CPU 10 performs, as shown in FIG. 17, a process to delete the note-off timing (the note-off timing Toff5 in FIG. 17). Hereinafter, this process will be described in detail.

At step S23, the CPU 10 determines whether or not the selected note-on timing has shifted beyond a note-off timing. The determination at step S23 can be performed based on whether or not a note-off timing, which corresponds to a note-on timing preceding the selected note-on timing by one note-on timing, follows the selected grid. To be specific, when the tic number of the note-off timing is greater than the tic number of the selected grid, it is determined that the selected note-on timing has shifted beyond the note-off timing. On the other hand, when the tic number of the note-off timing is no greater than the tic number of the selected grid, it is determined that the selected note-on timing has not shifted beyond the note-off timing. In the example of FIG. 17, a tic number T13 of the note-off timing Toff5 is greater than a tic number T12 of the selected grid Tg. Accordingly, it is determined that the selected note-on timing has shifted beyond the note-off timing. Note that, the note-off timing (i.e., the tic number of the note-off timing) can be obtained by referring to the note-off data 65 contained in the music performance data 63. When a determination result at step S23 is positive, a process at step S24 is performed. On the other hand, when the determination result at step S23 is negative, the process at step S24 is skipped, and the CPU 10 ends the timing shifting process.

At step S24, the CPU 10 deletes the note-off timing, beyond which the selected note-on timing has shifted. In other words, the note-off data 65 contained in the music performance data 63, which indicates the note-off timing, is deleted. In this manner, the note-off timing, which is present between the position of the selected note-on timing before the correction at step S22 and the position of the selected note-on timing after the correction at step S22, is deleted. Note that, the note-off timing to be deleted here is a note-off timing which does not correspond to the selected note-on timing, i.e., a note-off timing corresponding to a different note-on timing from the selected note-on timing. After step S24, the CPU 10 ends the timing shifting process.

On the other hand, at step S25, the CPU 10 shifts the selected note-on timing to be later. To be specific, similarly to the above step S22, the CPU 10 corrects the content of the note-on data 64, which content is indicated by the selected note-on data, such that the content indicates the tic number of the selected grid. In this manner, the selected note-on timing is shifted (corrected) to be positioned on the selected grid. After step S25, a process at step S26 is performed.

Here, in the case where the note-on timing is shifted to be later, it is conceivable that a note-off timing corresponding to the note-on timing is shifted to be later by a same shift amount as that of the note-on timing such that the note-on timing is not shifted beyond the corresponding note-off timing. However, in the case where the note-off timing is shifted to be later, there is a possibility that the note-off timing is shifted beyond a next note-on timing.

Figure 18:
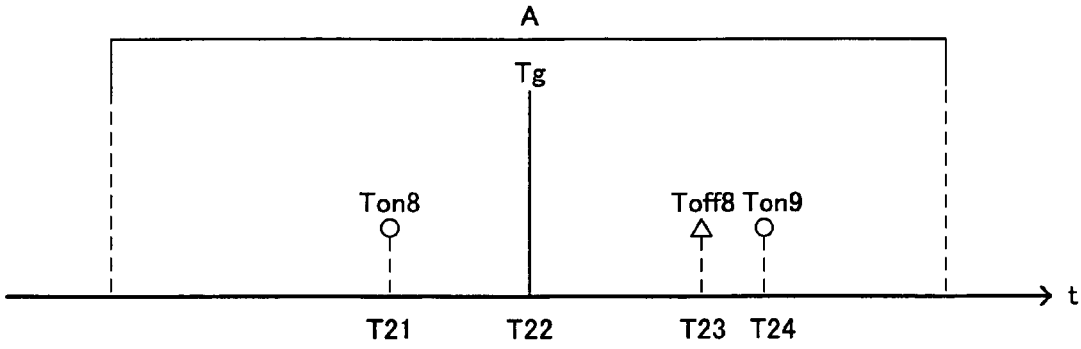
FIG. 18 shows that a selected note-on timing is shifted to be later.
Figure 19:
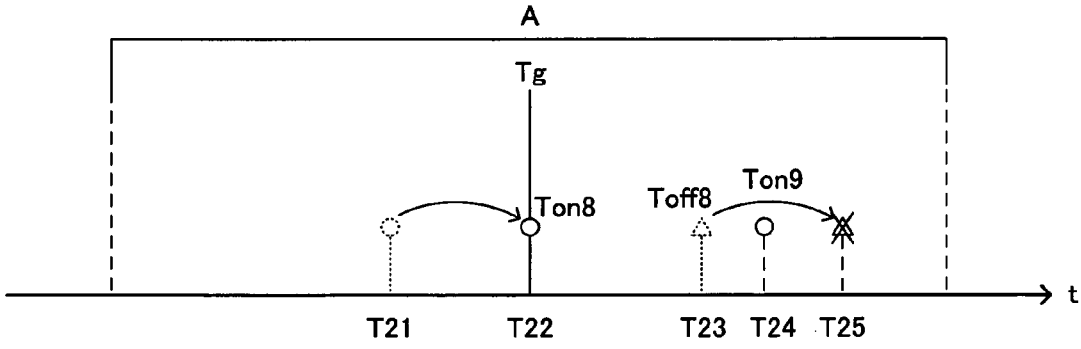
FIG. 19 shows that the selected note-on timing is shifted to be later.

FIGS. 18 and 19 show that the selected note-on timing is shifted to be later. In an area A, a note-on timing Ton8 (tic number=T21), a corresponding note-off timing Toff8 (tic number=T23>T21), and a note-on timing Ton9 (tic number=T24>T23) are set. Also, the note-on timing Ton8 is a selected note-on timing which is the nearest to a selected grid Tg (tic number=T22(T21<T22<T23)). Consider a case where in FIG. 18, the selected note-on timing Ton8 is shifted to be positioned on the selected grid Tg, and in response, the note-off timing Toff8 is shifted by a same shift amount as that of the selected note-on timing Ton8. To be specific, consider a case where the note-off timing Toff8 is shifted such that the tic number of the note-off timing Toff8 having been shifted is T25 (=T23+(T22−T21)). In this case, as shown in FIG. 19, the note-off timing Toff8 is shifted beyond the next note-on timing Ton9. As a result, similarly to the case shown in FIG. 17, the note-on timing is positioned to be earlier than the note-off timing which is originally earlier than the note-on timing. This results in a failure to present note-on and note-off timings properly.

Therefore, in the present embodiment, in the case where the note-off timing, which shifts in accordance with a shift of the selected note-on timing, shifts beyond a next note-on timing, the CPU 10 performs, as shown in FIG. 19, a process to delete the note-off timing (the note-off timing Toff8 in FIG. 19). Hereinafter, this process will be described in detail.

At step S26, the CPU 10 determines whether or not there is a note-off timing corresponding to the selected note-on timing. The determination at step S26 can be performed by referring to the note-off data 65 contained in the music performance data 63. When a determination result at step S26 is positive, a process at step S27 is performed. On the other hand, when the determination result at step S26 is negative, processes at steps S27 to S29 are skipped, and the CPU 10 ends the timing shifting process.

At step S27, the CPU 10 shifts the note-off timing corresponding to the selected note-on timing so as to delay the note-off timing. In other words, the CPU 10 adds a shift amount of the selected note-on timing to the tic number of the note-off timing, and corrects a content of the note-off data 65 indicating the note-off timing such that the content indicates the tic number resulting from the above addition. As a result, the note-off timing is shifted to be later by the same shift amount as that of the selected note-on timing. Note that, in the case where shifting the note-off timing by the same shift amount as that of the selected note-on timing causes the note-off timing to be positioned outside the area thereof, the CPU 10 shifts the note-off timing to be positioned within the area. To be specific, in the above case, the note-off timing is shifted to be positioned at the end of the area. After step S27, a process at step S28 is performed.

At step S28, the CPU 10 determines whether or not the note-off timing corresponding to the selected note-on timing has shifted beyond a note-on timing. The determination at step S28 can be performed based on whether or not the note-off timing follows a note-on timing which follows the selected note-on timing by one note-on timing. To be specific, when the tic number of the note-off timing is greater than the tic number of the note-on timing following the selected note-on timing by one note-on timing, it is determined that the note-off timing has shifted beyond the note-on timing. On the other hand, when the tic number of the note-off timing is no greater than the tic number of the note-on timing following the selected note-on timing by one note-on timing, it is determined that the note-off timing has not shifted beyond the note-on timing. When a determination result at step S28 is positive, a process at step S29 is performed. On the other hand, when the determination result at step S28 is negative, a process at step S29 is skipped, and then the CPU 10 ends the timing shifting process.

At step S29, the CPU 10 deletes the note-off timing which has shifted at step S27. In other words, the note-off data 65 contained in the music performance data 63, which indicates the note-off timing, is deleted. Thus, the note-off timing corresponding to the selected note-on timing is deleted. After, step S29, the CPU 10 ends the timing shifting process.

In the above timing shifting process, in the case where the selected note-on timing is shifted to be earlier, the corresponding note-off timing is not shifted. However, the note-off timing may be shifted in other embodiments. To be specific, the note-off timing may be shifted to be earlier by the same shift amount as that of the selected note-on timing.

Return to FIG. 13. After the timing shifting process at step S18, a process at step S19 is performed. At step S19, the CPU 10 determines whether or not there is a grid following the selected grid. To be specific, the CPU 10 determines whether or not the grid data 66 indicates a grid whose tic number is greater that that of the selected grid. When a determination result at step S19 is positive, a process at step S14 is performed again. Thereafter, the loop of processes at steps S14 to S19 is reiterated until a grid, which is most recently set on the temporal axis representing the period of the music performance, becomes a selected grid. On the other hand, when the determination process at step S19 is negative, the CPU 10 ends the music performance data correction process.

In the above-described music performance data correction process, for each grid, a note-on timing in a corresponding area, which is the nearest to said each grid, is selected (step S17), and the selected note-on timing is corrected to be positioned on said each grid (step S18). The selection and (if necessary) the correction of the note-on timing are performed until a final grid in the period of the music performance, whereby the entire music performance data 63 is corrected. Accordingly, the music performance data 63, which is stored in the main memory after the completion of the music performance data correction process, is the music performance data having been corrected.

Return to FIG. 12. After the music performance data correction process at step S2, a process at step S3 is performed. At step S3, the CPU 10 reads the music performance data 63, which has been corrected at step S2, from the main memory, and reproduces the music performance data 63. To be specific, the music performance represented by the music performance data 63 is replayed such that sounds are produced at the note-on timings indicated by the note-on data 64 contained in the music performance data 63, and the sounds are muted at the note-off timings indicated by the note-off data 65 contained in the music performance data 63. Thus, in the reproduction process at step S3, the music performance data inputted at step S1 is reproduced such that the music performance, for which some of the note-on timings have been corrected, is replayed. Also, each sound to be replayed (e.g., a pitch and/or a tone of each sound) is determined in accordance with data (contained in the music performance data) indicating a type of a key by which a corresponding note-on timing has been inputted. To be specific, information (e.g., a table) associating key types with sounds is stored in the main memory, and the CPU 10 refers to this information, thereby determining a sound to be produced at each note-on timing. Note that, when the music performance data 63 is reproduced, the CPU 10 may replay, similarly to the music performance data inputting process (step S1), an accompaniment together with the music performance represented by the music performance data 63. After step S3, a process at step S4 is performed. Note that, steps S2 and S3 are not necessarily performed immediately after step S1. Steps S2 and S3 may be performed in response to an instruction from a user.

At step S4, the CPU 10 determines whether or not to end the game. The determination at step S4 is performed based on, e.g., whether or not the player has provided an instruction to end the game. When a result of the determination at step S4 is negative, a process at step S1 is performed again. Thereafter, a loop of processes at steps S1 to S4 is reiterated until the CPU 10 determines to end the game at step S4. In other words, the music performance data inputting process, the music performance data correction process, and the reproduction process are reiterated. On the other hand, when the determination result at step S4 is positive, the CPU 10 ends the game process shown in FIG. 12. This is the end of the description of the game process.

As described above, in the game process according to the present embodiment, the music performance data is corrected in the above-described music performance data correction process, whereby in each area, only a nearest note-on timing to a grid is corrected to be positioned on the grid. This allows note-on timings in the inputted music performance data, each of which deviates from a grid, to be corrected, thereby reducing aberration in the result of the music performance. Further, since all the note-on timings are not necessarily corrected, the result of the music performance can be replayed while an intention included in the inputted music performance data is left uncorrected.

Note that, in the above game process, the music performance data 63 contains the note-on data 64 and the note-off data 65, and note-on timings and note-off timings are corrected in the music performance data correction process. However, in other embodiments, only the note-on timings may be corrected even if the music performance data 63 contains the note-off data 65.

Further, in the above embodiment, in an area, only a nearest note-on timing to a grid is corrected, and other note-on timings which are different from the nearest note-on timing (hereinafter, simply referred to as "other note-on timings") are not corrected (shifted). However, the present invention is not limited to the processing which does not correct the other note-on timings. In other embodiments, the game apparatus 3 may perform a process for shifting the other note-on timings (to different positions from a grid). Hereinafter, an example in which the other note-on timings are corrected will be described as a modification example of the above embodiment.

First Modification Example

Figure 20:
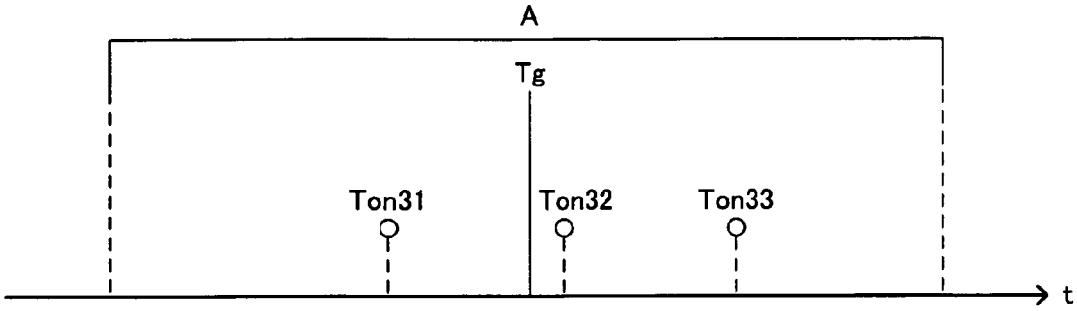
FIG. 20 shows note-on timings in an area, which have not been corrected.
Figure 21:
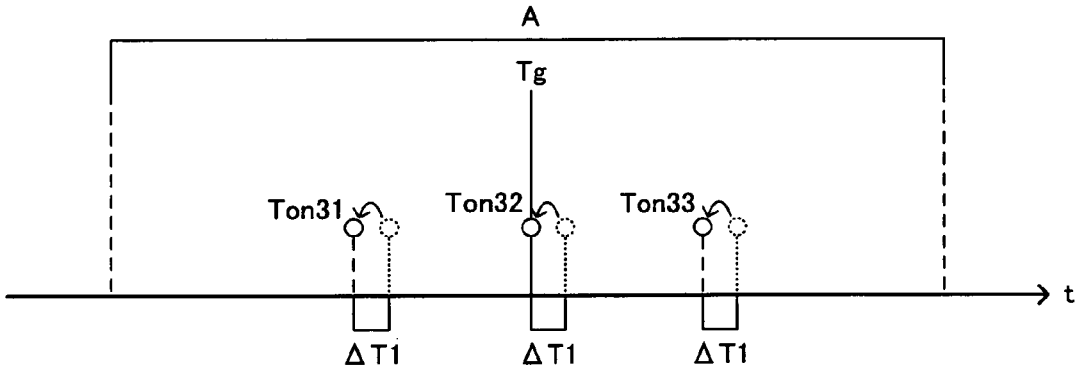
FIG. 21 shows the note-on timings which have been corrected by a first modification example.

Hereinafter, a process performed in the first modification example will be described with reference to FIGS. 20 and 21. FIG. 20 shows note-on timings in an area, which have not been corrected. Also, FIG. 21 shows the note-on timings which have been corrected according to the first modification example.

In FIG. 20, there are three note-on timings Ton31, Ton32 and Ton 33 at even intervals in an area A. A nearest note-on timing to a grid therein is the note-on timing Ton32. At this point, similarly to the above embodiment, the note-on timing Ton 32 is shifted to be positioned on a grid Tg as shown in FIG. 21. Further, in the first modification example, the CPU 10 shifts the other note-on timings Ton31 and Ton33 by a same shift amount and in a same direction as those of the nearest note-on timing Ton32 (see FIG. 21). To be specific, when it is assumed that the shift amount of the nearest note-on timing Ton32 are $\Delta T1$ tics, the other note-on timings Ton31 and Ton33 are each shifted to be earlier by $\Delta T1$ tics. Although FIGS. 20 and 21 illustrate a case where the nearest note-on timing is shifted to be earlier, the same is true for a case where the nearest note-on timing is shifted to be later.

To be specific, in the timing shifting process shown in FIG. 15, the CPU 10 performs, after the above step S22 or step S25, a process for shifting the other note-on timings by a same shift amount and in a same shift direction as those of the selected note-on timing. In the case where note-off timings corresponding to the note-on timings in the first modification example are set, the CPU 10 may shift the note-off timings by the same shift amount and in the same direction as those of the note-on timings. Note that, in the case where the note-on timings and the corresponding note-off timings are shifted in parallel, the CPU 10 may not perform the above-described steps S23, S24, S28 and S29.

Here, if an interval between a plurality of note-on timings indicated by the music performance data before the correction is different from the interval therebetween after the correction, the player may feel that the corrected music performance is strange. For example, in the case where there are the three note-on timings Ton31 to Ton33 at even intervals as shown in FIG. 20, shifting only the note-on timing Ton32 results in uneven intervals among the three note-on timings Ton31 to Ton33. Consequently, the player may feel that the corrected music performance is strange. Therefore, in the first modification example, the other note-on timings among the note-on timings within the area are corrected so as to maintain a time interval between the nearest note-on timing to the grid and each of the other note-on timings. This prevents a change in the intervals among the note-on timings within the area, and eliminates the strangeness which the player may feel about the corrected music performance.

Second Modification Example

Figure 22:
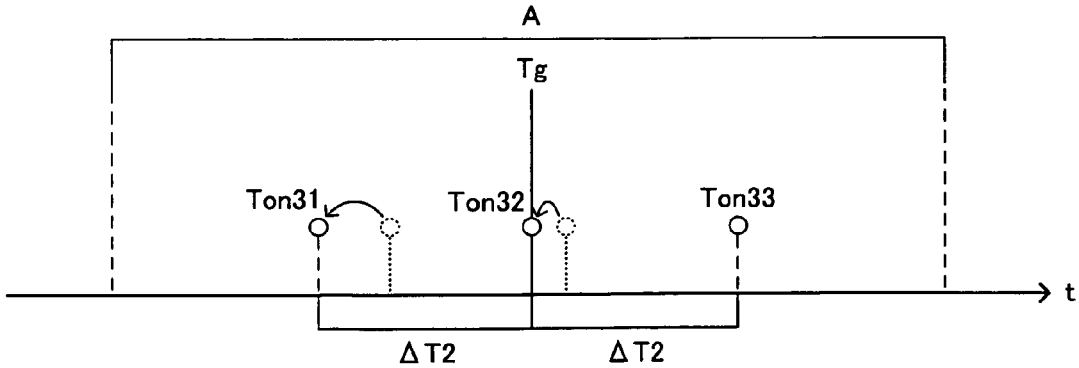
FIG. 22 shows the note-on timings which have been corrected by a second modification example.

Hereinafter, processing in a second modification example will be described with reference to FIGS. 20 and 22. FIG. 22 shows note-on timings which have been corrected in the second modification example. Similarly to the first modification example, the second modification example describes an exemplary case where the note-on timings which have not been corrected are positioned as shown in FIG. 20.

Similarly to the above-described embodiment, in the second modification example, the note-on timing Ton32 is shifted to be positioned on the grid Tg as shown in FIG. 22. Further, in the second modification example, the CPU 10 corrects at least one of the other note-on timings Ton31 and Ton33 such that a time interval ratio of the note-on timings Ton31 to Ton33 in the area A is maintained. In FIG. 22, the note-on timing Ton31 is shifted so as to maintain the time interval ratio. To be specific, the CPU 10 shifts the note-on timing Ton31 such that a ratio of an interval from the note-on timing Ton31 to the note-on timing Ton32 and an interval from the note-on timing Ton32 to the note-on timing Ton33 becomes (1:1) which is the same as before the correction. To be more specific, the CPU 10 shifts the note-on timing Ton31 such that the interval from the note-on timing Ton31 to the note-on timing Ton32 becomes equal to the interval from the note-on timing Ton32 to the note-on timing Ton33 ($\Delta T2$). FIG. 22 illustrates the exemplary case where the note-on timing Ton31 is shifted. However, in other embodiments, only the note-on timing Ton33 may be shifted, or both the note-on timings Ton31 and Ton 33 may be shifted. For example, the CPU 10 may shift at least one of the note-on timings Ton31 and Ton33 such that each of the note-on timings Ton31 and Ton33 is positioned within the area A after the shifting.

To be specific, in the timing shifting process shown in FIG. 15, the CPU 10 corrects, after the above step S22 or step S25, at least one of the other note-on timings so as to maintain a time interval ratio of the note-on timings in the area corresponding to the selected grid. In the second modification example, similarly to the first modification example, the CPU 10 may shift, in the case where note-off timings corresponding to the note-on timings are set, shift each note-off timing by a same shift amount and in a same direction as those of a corresponding note-on timing.

As described above, in the second modification example, when there are three or more note-on timings within an area, at least one of different note-on timings from a nearest note-on timing to a grid, is corrected such that a time interval ratio of the three or more note-on timings within the area is maintained. This, similarly to the first modification example, prevents intervals among the note-on timings within the area from varying from each other. As a result, this eliminates the strangeness which the player may feel about the corrected music performance.

(Exemplary Modification of Grid Setting)

In the above embodiment, the grids are set based on a single rule for the entire music performance period. For example, in the above first correction method, the grids in the entire music performance period are set at even intervals. On the other hand, in other embodiments, a plurality of types of grid setting manners may be applied in the entire music performance period. For example, in the above embodiment, in the case where a plurality of note-on timings are present within an area, the CPU 10 may set a plurality of subgrids within the area, and set, for each subgrid, a subarea including said each subgrid. In this case, similarly to the case of grid and area, the CPU 10 selects, from among note-on timings contained in a subarea, a nearest note-on timing to a subgrid. Then, the selected note-on timing is corrected to be positioned on the subgrid. In this manner, even if there are a number of note-on timings within the area, each note-on timing can be corrected to be an appropriate timing, and a plurality of note-on timings can be left within the area.

(Exemplary Modification of Area Setting)

In the above-described embodiment, areas are set such that an area corresponding to a grid adjoins to an area corresponding to a next grid (see FIGS. 8 and 14). However, it is not necessary in other embodiments that an area corresponding to a grid adjoins to an area corresponding to a next grid. There may be an interval between these two areas. In this case, there may be a note-on timing which is not included in any area, and this note-on timing is not to be corrected to be positioned on a grid. Accordingly, if it is desired that a note-on timing, which is present in a particular period in a music performance period, is not corrected, areas may be set such that the particular period is not included in an area of any grid. For example, by setting the areas such that a period, which is distant from a grid by a predetermined or longer interval, is set to be the above particular period, a note-on timing which is distant from the grid by the predetermined or longer interval is prevented from being corrected.

The present invention can be used as a game apparatus, game program or the like which is capable of: correcting music performance data inputted by a user (player) or the like, for the purpose of, e.g., adjusting rhythms therein while leaving information, which indicates the user's intention and which is originally contained in the music performance data, uncorrected; and then reproducing the music performance data.

While the invention has been described in detail, the foregoing description is in all aspects illustrative and not restrictive. It is understood that numerous other modifications and variations can be devised without departing from the scope of the invention.

What is claimed is:

1. A computer-readable storage medium for storing a musical piece correction program to be executed by a computer of a musical piece correction apparatus for correcting a sounding timing of a sound which constitutes a part of a musical piece, the musical piece correction program causing the computer to perform:

a music performance data reading step of reading, from storage memory of the musical piece correction apparatus, music performance data indicating sounding timings in the musical piece;

a reference timing setting step of setting a plurality of reference timings in a performance period of the musical piece;

a reference period setting step of setting, for each reference timing, a reference period including said each reference timing;

a selecting step of selecting, from among sounding timings included in the reference period, a nearest sounding timing to said each reference timing; and a correction step of correcting the sounding timing selected at the selecting step such that the sounding timing coincides with said each reference timing.

2. The storage medium according to claim 1, wherein at the reference timing setting step, the computer sets the plurality of reference timings at even intervals such that the reference timings each coincide with a timing at which a predetermined type of note is sounded, and at the reference period setting step, the computer sets the reference period so as to have a same length as an interval of the predetermined type of note corresponding to each of the reference timings.

3. The storage medium according to claim 2, wherein at the reference period setting step, the computer sets the reference period such that each of the reference timings is positioned at a center of the reference period.

4. The storage medium according to claim 1, wherein at the reference timing setting step, the computer sets the plurality of reference timings such that a first interval and a second interval having different lengths from each other alternately appear, and at the reference period setting step, the computer sets the reference period such that a middle point between a reference timing and a next reference timing is a border of two adjoining reference periods.

5. The storage medium according to claim 1, wherein at the selecting step, the computer selects, from among the sounding timings included in the reference period, the nearest sounding timing to said each reference timing, and at the correction step, the computer corrects only the sounding timing selected at the selecting step.

6. The storage medium according to claim 5, wherein the music performance data further contains data indicating muting timings of sounds constituting the musical piece, the musical piece correction program further causing the computer to perform a first deleting step of deleting a muting timing which is present between the selected sounding timing before a correction at the correction step and the selected sounding timing after the correction at the correction step, which muting timing is a muting timing of a different sound from a sound of the selected sounding timing.

7. The storage medium according to claim 5, wherein the music performance data further contains data indicating muting timings of sounds constituting the musical piece, the musical piece correction program further causing the computer to perform:

a shifting step of shifting a muting timing, which corresponds to the selected sounding timing, in a same direction and by a same amount as those of the selected sounding timing; and a second deleting step of deleting the muting timing in the case where at the shifting step, the muting timing is shifted beyond a sounding timing of a sound which is different from a sound of the muting timing.

8. The storage medium according to claim 1, wherein at the correction step, the computer corrects a sounding timing, which is one of the sounding timings included in the reference period and which has not been selected at the selecting step, such that a time interval between the sounding timing and the selected sounding timing is maintained.

9. The storage medium according to claim 1, wherein at the correction step, in the case where there are a plurality of sounding timings which are among the sounding timings included in the reference period and which have not been selected at the selecting step, the computer corrects at least one of the plurality of sounding timings which have not been selected, such that a time interval ratio of the sounding timings included in the reference period is maintained.

10. The storage medium according to claim 1, wherein the musical piece correction program further causes the computer to perform:

a music performance data inputting step of inputting the music performance data and causing the storage memory to store the music performance data;

a corrected data storing step of causing storage memory of the musical piece correction apparatus to store the music performance data whose sounding timing has been corrected at the correction step; and a replaying step of reading the music performance data which has been corrected, and replaying the musical piece.

11. A musical piece correction apparatus for correcting a sounding timing of a sound which constitutes a part of a musical piece, the musical piece correction apparatus comprising:

music performance data reading programmed logic circuitry for reading, from storage memory of the musical piece correction apparatus, music performance data indicating sounding timings in the musical piece;

reference timing setting programmed logic circuitry for setting a plurality of reference timings in a performance period of the musical piece;

reference period setting programmed logic circuitry for setting, for each reference timing, a reference period including said each reference timing;

selecting programmed logic circuitry for selecting, from among sounding timings included in the reference period, a nearest sounding timing to said each reference timing; and correction programmed logic circuitry for correcting the sounding timing selected by the selecting programmed logic circuitry such that the sounding timing coincides with said each reference timing.

12. The musical piece correcting apparatus according to claim 11, wherein the reference timing setting programmed logic circuitry sets the plurality of reference timings at even intervals such that the reference timings each coincide with a timing at which a predetermined type of note is sounded, and the reference period setting programmed logic circuitry sets the reference period so as to have a same length as an interval of the predetermined type of note corresponding to each of the reference timings.

13. The musical piece correction apparatus according to claim 12, wherein the reference period setting programmed logic circuitry sets the reference period such that each of the reference timings is positioned at a center of the reference period.

14. The musical piece correction apparatus according to claim 11, wherein the reference timing setting programmed logic circuitry sets the plurality of reference timings such that a first interval and a second interval having different lengths from each other alternately appear, and the reference period setting programmed logic circuitry sets the reference period such that a middle point between a reference timing and a next reference timing is a border of two adjoining reference periods.

15. The musical piece correction apparatus according to claim 11, wherein the selecting programmed logic circuitry selects, from among the sounding timings included in the reference period, the nearest sounding timing to said each reference timing, and the correction programmed logic circuitry corrects only the sounding timing selected at the selecting step.

16. The musical piece correction apparatus according to claim 15, wherein the music performance data indicates muting timings of sounds constituting the musical piece, the musical piece correction apparatus further comprising first deleting programmed logic circuitry for deleting a muting timing which is present between the selected sounding timing before a correction by the correction programmed logic circuitry and the selected sounding timing after the correction by the correction programmed logic circuitry, which muting timing is a muting timing of a different sound from a sound of the selected sounding timing.

17. The musical piece correction apparatus according to claim 15, wherein the music performance data indicates muting timings of sounds constituting the musical piece, the musical piece correction apparatus further comprising:

shifting programmed logic circuitry for shifting a muting timing, which corresponds to the selected sounding timing, in a same direction and by a same amount as those of the selected sounding timing; and second deleting programmed logic circuitry for deleting the muting timing in the case where the shifting programmed logic circuitry shifts the muting timing beyond a sounding timing of a sound which is different from a sound of the muting timing.

18. The musical piece correction apparatus according to claim 11, wherein the correction programmed logic circuitry corrects a sounding timing, which is one of the sounding timings included in the reference period and which has not been selected by the selecting programmed logic circuitry, such that a time interval between the sounding timing and the selected sounding timing is maintained.

19. The musical piece correction apparatus according to claim 11, wherein in the case where there are a plurality of sounding timings which are among the sounding timings included in the reference period and which have not been selected by the selecting programmed logic circuitry, the correction programmed logic circuitry corrects at least one of the plurality of sounding timings which have not been selected, such that a time interval ratio of the sounding timings included in the reference period is maintained.

20. The musical piece correction apparatus according to claim 11, further comprising:

music performance data inputting programmed logic circuitry for inputting the music performance data and causing the storage memory to store the music performance data;

corrected data storing memory for causing storage memory of the musical piece correction apparatus to store the music performance data whose sounding timing has been corrected by the correction programmed logic circuitry; and replaying programmed logic circuitry for reading the music performance data which has been corrected, and replaying the musical piece.

* * * * *